United States Patent [19]

Osawa et al.

[11] Patent Number: 4,882,256

[45] Date of Patent: Nov. 21, 1989

[54] PHOTOSENSITIVE MEMBER HAVING AN OVERCOAT LAYER COMPRISING AMORPHOUS CARBON

[75] Inventors: Izumi Osawa, Ikeda; Syuji Iino, Hirakata; Hideo Hotomi, Suita; Kenji Masaki, Osaka; Isao Doi, Toyonaka, all of Japan

[73] Assignee: Minolta Camera Kabushiki Kaisha, Osaka, Japan

[21] Appl. No.: 107,541

[22] Filed: Oct. 13, 1987

[30] Foreign Application Priority Data

| | | | |
|---|---|---|---|
| Oct. 14, 1986 | [JP] | Japan | 61-245080 |
| Oct. 14, 1986 | [JP] | Japan | 61-245081 |
| Oct. 14, 1986 | [JP] | Japan | 61-245082 |
| Jul. 15, 1987 | [JP] | Japan | 62-178051 |
| Jul. 15, 1987 | [JP] | Japan | 62-178052 |

[51] Int. Cl.[4] ..... G03G 5/14

[52] U.S. Cl. ..... 430/66; 430/132

[58] Field of Search ..... 430/66, 67, 132

[56] References Cited

U.S. PATENT DOCUMENTS

| | | | |
|---|---|---|---|
| 3,956,525 | 5/1976 | Yasuba . | |
| 4,366,208 | 12/1982 | Akai et al. . | |
| 4,394,425 | 7/1983 | Shimiza et al. . | |
| 4,490,450 | 12/1984 | Shimizu et al. . | |
| 4,544,617 | 10/1985 | Mort et al. | 430/58 |
| 4,675,265 | 6/1987 | Kazami et al. . | |
| 4,770,966 | 2/1988 | Kazama et al. | 430/66 |
| 4,774,130 | 9/1988 | Endo et al. | 428/215 X |

FOREIGN PATENT DOCUMENTS

| | | |
|---|---|---|
| 50-30526 | 3/1975 | Japan . |
| 51-46130 | 4/1976 | Japan . |
| 55-86169 | 6/1980 | Japan . |
| 56-62254 | 5/1981 | Japan . |
| 57-64239 | 4/1982 | Japan . |
| 58-139154 | 8/1983 | Japan . |
| 59-136742 | 8/1984 | Japan . |
| 59-214859 | 12/1984 | Japan . |
| 61761 | 4/1985 | Japan . |
| 60-101541 | 6/1985 | Japan . |
| 60-249115 | 12/1985 | Japan . |
| 60-249155 | 12/1985 | Japan . |
| 61-94056 | 5/1986 | Japan . |
| 61-289355 | 12/1986 | Japan . |

OTHER PUBLICATIONS

Journal of Applied Polymer Science, vol. 17, 1973.

"A C-nmr Investigation of Plasma Polymerized Ethane, Ethylene, and Acetylene" Dilks et al, Journal of Polymer Science, vol. 19, 1981.

W. E. Spear and P. G. Le Comber, "Electronic Properties of Substitutionally Doped Amorphous Si and Ge", Philosophical Magazine, 1976, vol. 33, No. 6,935-949.

"Photosensitive Materials for Electron Photography-OPC vs. Inorganics," Nikkei New Materials, Dec. 15, 1986.

Mitchell Shen and Alexis T. Bell, "A Review of Recent Advances in Plasma Engineering", Review of Recent Advances, Mar. 29, 1979.

John A. Woollam ewt al, "Optical and Interfacial Electronic Properties of Diamond-Like Carbon Films."

*Primary Examiner*—J. David Welsh

*Attorney, Agent, or Firm*—Burns, Doane, Swecker & Mathis

[57] ABSTRACT

A photosensitive member of the present invention comprises an electrically conductive substrate, a photoconductive layer comprising an organic material and a hydrogen-containing amorphous carbon overcoat layer containing one or more atoms selected from the group consisting of halogen, oxygen and nitrogen.

The overcoat layer contains hydrogen in an amount of about 5 to about 50 atomic % based on the combined amount of hydrogen atoms and carbon atoms.

22 Claims, 3 Drawing Sheets

PHOTOSENSITIVE MEMBER HAVING AN OVERCOAT LAYER COMPRISING AMORPHOUS CARBON

BACKGROUND OF THE INVENTION

1. Field of the Invention:

The present invention relates to a photosensitive member comprising an overcoating layer on a photosensitive layer of organic materials.

2. Description of the Prior Art:

Remarkable developments have continued to be made in the application of electrophotographic techniques since the invention of the Carlson process. Various materials have also been developed for use in electrophotographic photosensitive members.

Organic materials used for the construction of electrophotographic photosensitive members are well known to those skilled in the art (for example, the materials disclosed in the Dec. 15, 1986 issue of Nikkei New Materials, pages 83–98), and these materials have made superior photosensitive members practical from the standpoints of sensitivity, chargability and construction costs.

Materials used in the construction of organic photosensitive members are, in general, photoconductive materials which produce an electric charge such as, for example, phthalocyanine series pigments, azo series pigments, perillene series pigments and the like, electrical charge transporting materials such as, for example, triphenylmethanes, triphenylamines, hydrazones, styryl compounds, pyrazolines, oxazoles, oxydiazoles, and the like, binding materials for dispersion coating such as, for example, polyester, polyvinyl butyral, polycarbonate, polyarylate, phenoxy, styrene-acryl, and other resins.

Repeated use of these types of photosensitive members, however, gives rise to problems of image defects, white streaks, and the like. These problems arise because the surface hardness of the organic photosensitive member roughly falls within the range from the 5B to B levels of the JIS standards for pencil lead hardness, thus the surface of the photosensitive member is readily damaged due to the friction which is generated when the member comes into contact with the transfer paper, cleaning components, developer, and the like. Another cause of such problems is the harsh surface contact made when paper jams occur and the resultant reversion to manual operation required to remedy the malfunction. Furthermore, damage to the surface of the photosensitive member results in a marked reduction in the surface potential of the member.

In order to eliminate these disadvantages, it is proposed that the surface of the photosensitive member be covered with a protective layer.

The technology described in U.S. Pat. No. 3,956,525 discloses a photosensitive member manufacturing process wherein a photosensitive layer has sequentially laminated thereon a selenium layer or selenium-tellurium alloy layer and a polyvinyl carbazole and a polymer film formed by glow discharge polymerization is coated thereon.

The technology described in Unexamined Japanese Patent Publication Sho 60-61761 discloses a photosensitive member comprising a photoactive layer covered by a diamond carbon layer.

The technology described in U.S. Pat. No. 4,544,617 discloses a photosensitive member comprising an amorphous silicon carrier generation and transport layer, trapping layer doped with boron or phosphorous, and an overcoating layer comprised of silicon nitride, silicon carbide or amorphous carbon.

Although the aforesaid manufacturing process disclosed in U.S. Pat. No. 3,956,525 improves the solvent resistance of the photosensitive member, moisture and friction resistances are inadequate, which gives rise to the disadvantages of image drift and cutting. Furthermore, there is no suggestion in the disclosure concerning improving these disadvantages.

The photosensitive member disclosed in Unexamined Japanese Patent Publication Sho 60-61761 also has the disadvantages of poor moisture resistance and the production of image drift.

On the other hand, most organic photosensitive members have poor heat resistance, that is to say, photosensitivity is reduced when such a member is subjected to a excessive high-temperature heating during the process for providing a protective overcoating layer. The technology disclosed in the aforesaid Unexamined Japanese Patent Publication Sho 60-61761 suggests a process for the manufacture of a photoactive layer wherein a diamond carbon layer is successively formed on an amorphous silicon layer normally manufactured at 150° to 300° C. When this process is used on an organic photosensitive member, however, it presents the disadvantage in that the photosensitivity of said member is completely lost.

The photosensitive member disclosed in the aforesaid U.S. Pat. No. 4,544,617 also has poor moisture resistance which has the disadvantage of leading to the production of image drift. This process cannot be applied to the organic photosensitive members because the substrate is subjected to high temperatures during the overcoating layer formation process.

An organic photosensitive member has a relatively soft and easily damagable surface and further does not possess an overcoat protective layer effective at preventing the production of image drift during long-term use.

SUMMARY OF THE INVENTION

A main object of the present invention is to provide a photosensitive member the surface of which will not be damaged with repeated use and which has superior resistance to environmental factors.

Another object of the invention is to provide a photosensitive member which will not give rise to image drift.

A further object of the invention is to provide a photosensitive member having an overcoating protective layer formed thereon which will not peel off due to mechanical contact or fluctuations in moisture or temperature when used in a copying machine.

A still further object of the invention is to provide a process for the manufacture of a photosensitive member having a protective overcoating layer formed thereon without harm to the sensitivity characteristics of an organic photosensitive layer.

These and other objects of the present invention are accomplished by means of providing a photosensitive member comprising a conductive substrate and a photosensitive layer formed of organic material, said photosensitive layer having formed thereon an overcoating layer comprising amorphous carbon containing hydrogen which contains at least halogen atoms, nitrogen atoms and oxygen atoms, and a process for manufacturing the same.

BRIEF DESCRIPTION OF THE DRAWINGS

In the following description, like parts are designated by like reference numbers throughout the several drawings.

DETAILED DESCRIPTION OF THE INVENTION

Figure 1:
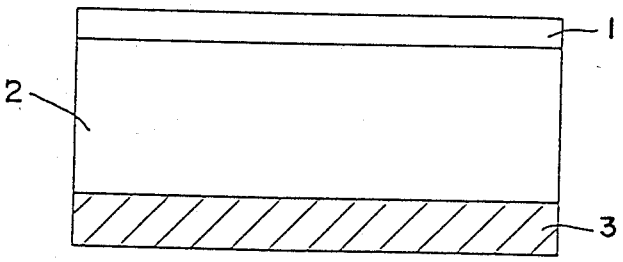
FIG. 1 shows the basic structure of the photosensitive member related to the present invention.

FIG. 1 shows an example of the construction of a photosensitive member of the present invention wherein a conductive substrate 3 has sequentially laminated thereon a photosensitive layer 2 and an overcoating layer 1 formed of an amorphous hydrocarbon layer.

A photosensitive layer 2 is provided on a conductive substrate 3 thereby forming an organic photosensitive member, and the interior construction of said photosensitive layer 2 may be a functionally separated construction having a laminated charge producing layer and a charge transporting layer, a binder-type construction having a charge producing material and charge transporting material dispersed throughout a binding material, or other construction.

The conductive substrate 3 may be at a minimum a material which is conductive on its outermost surface, and may be a cylinder, a flexible belt, a flat plate, or some other arbitrary shape.

The characteristics of the present invention is an overcoating layer 1 having at a minimum halogen atoms, oxygen atoms, and nitrogen atoms in an amorphous carbon layer (hereinafter referred to as an a-C layer).

The amorphous carbon layer itself has a hardness rating of 4H, but becomes harder and more damage resistant by means of the addition of at a minimum halogen atoms, oxygen atoms and nitrogen atoms, the addition of said atoms providing an overcoating layer 1 which has comparatively superior moisture resistance, assures suitable chargability, and has superior transparency to light.

The halogen atoms may be fluorine, chlorine, bromine, or iodine atoms. Fluorine atoms in particular provide exceptionally superior results from the standpoint of moisture resistance.

The effective moisture resistance imparted by the addition of fluorine atoms is thought to be from the introduction of strongly water-repellant fluorine atoms into the layer and the increased density of the layer due to a dehydration reaction induced by the fluorine atoms in the layer.

The a-C layer of the present invention contains 0.01 to 50 atomic %, preferably 0.1 to 10 atomic %, and ideally 0.5 to 5 atomic %, of halogen atoms based on the total amount of constituent atoms in the structure.

If the amount of halogen atoms exceeds 50 atomic % based on all the constituent atoms of the a-C layer, the appropriate layer information cannot necessarily be assured.

Nitrogen and oxygen atoms are believed to have their weak bonds forcibly broken and reformed during the reaction, without bond dissociation induced by corona discharge and the like, due to the formation of strong bonds between nitrogen/carbon atoms and oxygen/carbon atoms. The result is the prevention of moisture adhesion.

For this reason it is preferable that the nitrogen and oxygen atoms be used as separate material gases, to wit, it is desirable to conduct the reaction with the atoms in a temporarily dissociated state.

The a-C layer contains 0.01 to 20 atomic %, preferably 0.1 to 10 atomic %, and ideally 0.5 to 5 atomic %, of nitrogen and oxygen atoms based on all the constituent atoms in the entire structure.

If the amount of nitrogen and oxygen atoms exceeds 20 atomic % based on all the constituent atoms of the a-C layer, the appropriate layer formation cannot necessarily be assured. In particular, a remarkable layer etching effect caused by the oxygen atoms during the layer formation process leads to an undesirable reduction in the speed of layer formation.

Although there is no particular limitation on the amount of hydrogen atoms which may be contained in the a-C layer, the amount is necessarily restricted by overcoating layer manufacturing concerns and glow discharge processes, said amount being, in general, 5 to 50 atomic %.

The amount of carbon, hydrogen, halogen, nitrogen, oxygen and like atoms contained in the a-C layer can be determined by means of organic elementary analysis, Auger-electron spectroscopy analysis and the like. The a-C layer may contain the halogen, nitrogen or oxygen atoms singly, and may contain two or more of the above types of atoms.

The overcoating layer 1 of the present invention is formed at a thickness of 0.01 to 5 μm, preferably 0.05 to 2 μm, and ideally 0.1 to 1 μm. A layer with a thickness of less than 0.01 μm has reduced hardness and is readily damaged. Also, a layer with a thickness exceeding 5 μm has reduced transparency to light and causes reduced sensitivity of the photosensitive member because the exposed light cannot be effectively conducted to the organic photosensitive layer.

The aforesaid halogen, oxygen and nitrogen atoms may be incorporated so as to be distributed uniformly or unevenly throughout the width of said overcoating layer 1. When distributed unevenly, the region having an majority of these atoms, in the direction of the layer thickness, shall have these atoms in amounts within the ranges heretofore described.

Particularly, high density distribution of halogen atoms in the vicinity of the layer surface in particular can be effected by, post-layer formation, plasma surface processing of the molecules containing the halogen atoms, in which case density distributions as high as 40 to 50 atomic % are possible.

The overcoating layer 1 of the photosensitive member of the present invention may be formed on an organic photosensitive member, thus achieving the objects of the present invention.

The overcoating layer 1 is formed by means of a glow discharge process. The overcoating layer 1 is formed by discharging at reduced pressure gaseous-phase molecules containing at least carbon atoms and molecules containing hydrogen atoms together with at least molecules containing halogen atoms, molecules having oxygen atoms and/or molecules having nitrogen atoms. This diffuses onto the substrate the activated neutral atoms and charged atoms in the plasma production region, and induces by electrical or magnetic force or the like, formation on the substrate of a solid phase via a recombination reaction. The formation of the overcoating layer 1 can be regulated, via the aforesaid plasma reaction (hereinafter referred to as P-CVD reaction), to form an amorphous hydrocarbon layer incorporating at least halogen atoms, nitrogen atoms, and oxygen atoms.

The present invention employs a gaseous mixture of hydrocarbon and at least halogen, oxygen and/or nitrogen as the starting materials for forming the a-C layer via a glow discharge process. Common hydrogen or argon gas are used as a carrier.

These hydrocarbons need not always be in a gaseous phase at room temperature and atmospheric pressure, but can be in a liquid or solid phase insofar as they can be vaporized as by melting, evaporation or sublimation, for example, with heating or in a vacuum. Examples of these hydrocarbons are saturated hydrocarbons, unsaturated hydrocarbons, alicyclic hydrocarbons, aromatic hydrocarbons and the like.

A wide variety of hydrocarbons are usable. Examples of useful saturated hydrocarbons are normal paraffins, such as methane, ethane, propane, butane, pentane, hexane, heptane, octane, isobutane, isopentane, neopentane, isohexane, neohexane, dimethyl-butane, methylhexane, ethylpentane, dimethylpentane, tributane, methylheptane, dimethyl-hexane, 2,2,5-dimethylhexane, trimethylpentane, isononane, and the like.

Examples of useful unsaturated hydrocarbons are ethylene, propylene, isobutylene, butene, pentene, methylbutene, hexene, tetramethylethylene, heptene, octene, allene, methylallene, butadiene, pentadiene, hexadiene, cyclopentadiene, ocimene, alloocimene, myrcene, hexatriene, acetylene, methylacetylene, butyne, pentyne, hexyne, heptyne, octyne, butadiyne, and the like.

Examples of useful alicyclic hydrocarbons are cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, fenchene, cyclofenchene, tricyclene, bisabolene, zingiberene, curcumene, humulene, cadinen, sesquibenihene, selinene, caryophyllene, santalene, cedrene, camphorene, phyllocladene, podocarpene, mirene and the like.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. Considering the formation of a layer of good quality, unsaturated hydrocarbons are desirable because they are reactive. Especially, the most desirable are butadiene and propylene.

The hydrogen content of the a-C layer of the invention is variable in accordance with the film forming apparatus and film forming conditions. Hydrogen content can be decreased, for example, by elevating the substrate temperature, lowering the pressure, reducing the degree of dilution of the starting materials, i.e., the hydrocarbon gases, applying greater power, decreasing the frequency of the alternating electric field to be set up or increasing the intensity of a d.c. electric field superposed on the alternating electric field.

A gaseous halogen mixture may be used in the present invention in addition to the hydrocarbon gases, at least to add halogen atoms to the a-C layer. The halogen atoms may be fluorine atoms, chlorine atoms, bromine atoms and iodine atoms. The aforesaid gaseous halogen mixture need not necessarily be in the gaseous phase at room temperature and atmospheric pressure, namely, the halogen mixture can also be in liquid or solid phase as they can be vaporized by melting, evaporation or sublimation via heating or by a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodine chloride, hydrogen bromide, iodine bromide, hydrogen iodide, and the like; and organic compounds such as alkyl halides, alkyl-metal halides, allyl halides, halogenated silicic esters, stylene halides, polymethylene halides, halogen substituted organosilanes, haloform, and the like.

Examples of useful alkyl halides are methyl flouride, methyl chloride, methyl bromide, methyl iodide, ethyl fluoride, ethyl chloride, ethyl bromide, ethyl iodide, propyl fluoride, propyl chloride, propyl bromide, propyl iodide, butyl fluoride, butyl chloride, butyl bromide, butyl iodide, amyl fluoride, amyl chloride, amyl bromide, amyl iodide, hexyl fluoride, hexyl chloride, hexyl bromide, hexyl iodide, heptyl fluoride, heptyl chloride, heptyl bromide, heptyl iodide, octyl fluoride, octyl chloride, octyl bromide, octyl iodide, nonyl fluoride, nonyl chloride, nonyl bromide, nonyl iodide, decyl fluoride, decyl chloride, decyl bromide, decyl iodide, and the like. Examples of useful allyl halides are fluorobenzene, chlorobenzene, bromobenzene, iodobenzene, chlorotoluene, bromotoluene, chloronaphthalene, bromonaphthalene, etc.; examples of styrene halides are chlorostyrene, bromostyrene, iodostyrene, fluorostyrene, and the like. Useful examples of polymethylene halides are methylene chloride, methylene bromide, methylene iodide, ethylene chloride, ethylene bromide, methylene iodide, ethylene chloride, ethylene bromide, ethylene iodide, trimethylene chloride, trimethylene bromide, trimethylene iodide, dichlorobutane, dibromobutane, diiodobutane, dichloropentane, dibromopentane, diiodopentane, dichlorohexane, dibromohexane, diiodohexane, dichloroheptane, dibromoheptane, diiodoheptane, dichlorooctane, dibromooctane, diiodooctane, dichlorononane, dibromononane, dichlorodecane, diiododecane, and the like. Examples of haloforms are fluoroform, chloroform, bromoform, iodoform, and the like.

Useful examples of halogen substituted hydrocarbons are carbon tetrafluoride, vinylidene fluoride, perfluoro ethylene, perfluoro propane, perfluoro propylene, difluoro propane, and the like.

From the perspectives of film-forming ability, ease of gas handling and cost, the most desirable compounds are carbon tetrafluoride, perfluoro ethylene, perfluoro propylene and the like.

The amount of halogen atoms incorporated in the amorphous hydrogen layer can be regulated at least by means of increasing or decreasing the amount of molecules containing halogen atoms used in the P-CVD reaction.

In the present invention, gaseous nitrogen compounds may be used in addition to the aforesaid hydrocarbon gas mixture at least for the purpose of adding nitrogen atoms to the a-C layer. The aforesaid gaseous nitrogen mixture need not necessarily be in the gaseous phase at room temperature and atmospheric pressure as a liquid or solid phase can be vaporized as by melting, evaporation or sublimation via heating or in a vacuum. The nitrogen compound may be any of a number of inorganic compounds such as, for example, ammonia, nitrogen monoxide, nitrogen dioxide, and any of a number of organic compounds having heterocyclic functional groups containing nitrogen or nitrogen-containing bonds such as the amino radical (—$NH_2$), cyano radical (—CN), and the like. Examples of useful organic compounds having amino radicals are methylamine, ethylamine, propylamine, butylamine, amylamine, hexylamine, heptylamine, octylamine, nonylamine, decylamine, undecylamine, dodecylamine, tridecylamine, tetradecylamine, pentadecylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, hydrazine, aniline, methylaniline, dimethylaniline, ethylaniline, diethylaniline, toluidine, benzylamine, dibenzylamine, tribenzylamine, diphenylamine, triphenylamine, naphthylamine, ethylene diamine, trimethylene diamine, tetramethylene diamine, pentamethylene, diamine, hexamethylene diamine, pentamethylene diamine, hexamethylene diamine, diaminohepane, diaminooctane, diaminononane, diamonodecane, phenylene diamine, and the like. Some useful organic compounds having cyano radicals are, for example, acetonitrile, propionitrile, butyronitrile, valeronitrile, capronitrile, enantonitrile, capryronitrile, ferralgonitrile, caprynitrile, lauronitrile, palmitonitrile, stearonitrile, crotononitrile, malononitrile, succinonitrile, glutaronitrile, adiponitrile, benzonitrile, tolunitrile, cyanobenzylic cinnamonitrile, naphthonitrile, cyanpyridine, and the like. Useful heterocyclic compounds are, for example, pyrrole, pyrroline, pyrrolidine, oxazole, thiazole, imidazole, imidazoline, imidazoledine, pyrazole, pyrazoline, pyrazoledine, triazole, tetrazole, pyridine, piperidine, oxazine, morpholine, thiazine, pyridazine, pyrimidine, pyrazine, pyperazine, triazine, indole, indoline, benzoxazole, indazole, benzoimidazole, quinoline, cinnoline, phthalazine, phthalocyanine, quinazoline, quinoxaline, carbazole, acridine, phenanthridine, phenazine, phenoxazine, indolizine, quinolizine, quinuclidine, naphthyladine, purine, pteridine, aziridine, azepine, oxadiazine, dithiazine, benzoquinoline, imidazolethiazole, and the like.

From the perspectives of film-forming ability, ease of gas handling and cost, the most desirable materials are nitrogen, ammonia and the like.

The amount of nitrogen atoms incorporated in the amorphous hydrocarbon layer can be regulated at least by increasing or decreasing the amount of molecules containing halogen atoms used in the P-CVD reaction.

In the present invention, gaseous oxygen compounds may be used in addition to the aforesaid hydrocarbon gas mixture at least for the purpose of adding oxygen atoms to the a-C layer. The aforesaid gaseous oxygen mixture need not necessarily be in the gaseous phase at room temperature and atmospheric pressure as a liquid or solid phase can be vaporized by melting, evaporation or sublimation via heating or in a vacuum. While oxygen and ozone are usable for this purpose, example of useful inorganic compounds are water vapor, nitrous oxide, nitrogen monoxide, nitrogen doixide, carbon monoxide, carbon dioxide, carbon suboxide, etc., and organic compounds having heterocyclic functional radicals containing oxygen or oxygen-containing bonds such as the hydroxyl radical (—OH), aldehyde radical (—COH), acyl radical (RCO—, —CRO), ketone radical (>CO), ether bond (—O—), ester bond (—COO—), and the like. Among the useful organic compounds having the hydroxyl radical are methanol, ethanol, propanol, butanol, allyl alcohol, fluoroethanol), fluorobutanol, phenol, cyclohexanol, benzyl alcohol, furfuryl alcohol, etc. Among the organic compounds which may be used having a aldehyde radical are, for example, formaldehyde, acetaldehyde, propionaldehyde, butylaldehyde, glyoxal, acrolein, benzaldehyde, furfural, and the like. Useful organic compounds having an acyl radical are, for example, formic acid, acetic acid, propionic acid, butyric acid, valeric acid, palmitic acid, stearic acid, oleic acid, oxalic acid, malonic acid, succinic acid, benzoic acid, toluic acid, salicyclic acid, cinnamic acid, naphthoic acid, phthalic acid, furoic acid, etc. Useful organic compounds having a ketone radical are, for example, acetone, ethyl methyl ketone, methyl propyl ketone, butyl methyl ketone, pinacolone, diethyl ketone, methyl vinyl ketone, mesityl oxide, methyl heptanone, cyclobutanone, cyclopentanone, cyclohexanone, acetophenone, propiophenone, butylphenone, valerophenone, dibenzyl ketone, acetonaphthone, acetophenone, acetofuran, and the like. Examples of useful organic compounds having ether bonds are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ether amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyrane, dioxane, and the like. Useful organic compounds having ester bonds are, for example, methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate, and the like. Examples of useful heterocyclic compounds containing oxygen are furan, oxyzole, furazan, pyrane, oxazine, morpholine, benzofuran, benzoxazole, chromane, dibenzofuran, xanthene, phenoxanthene, oxirane, dioxirane, oxathiorane, oxadiazine, benzoisoxazole, and the like.

From the perspectives of film-forming ability, ease of gas handling and cost, the most desirable materials are carbon dioxide, oxygen and the like.

The amount of oxygen atoms incorporated in the amorphous hydrocarbon layer can be regulated at least by increasing or decreasing the amount of molecules containing oxygen atoms used in the P-CVD reaction.

Figure 2:
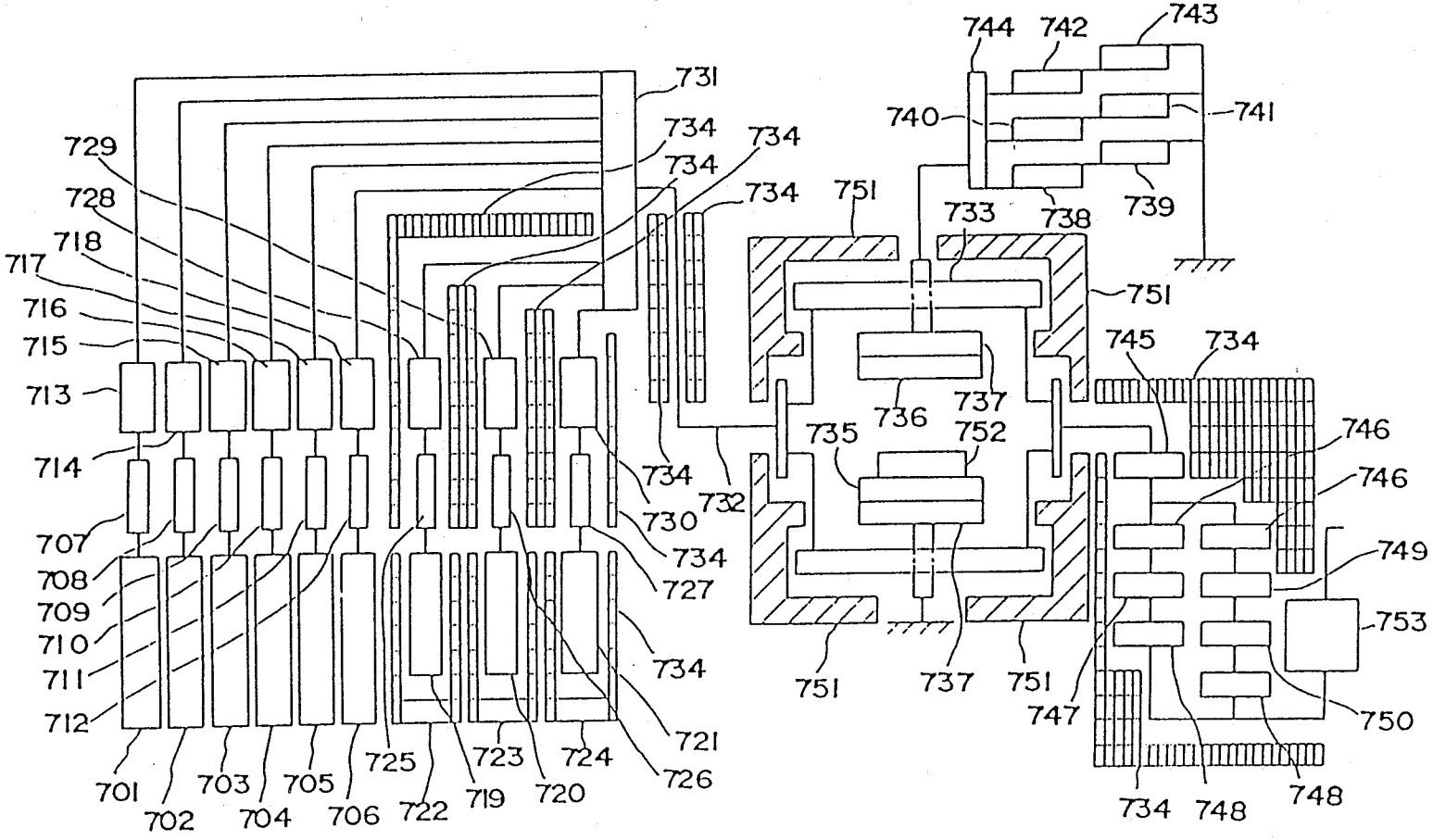
FIGS. 2 and 3 show the manufacturing device used to manufacture the photosensitive member of the present invention.
Figure 3:
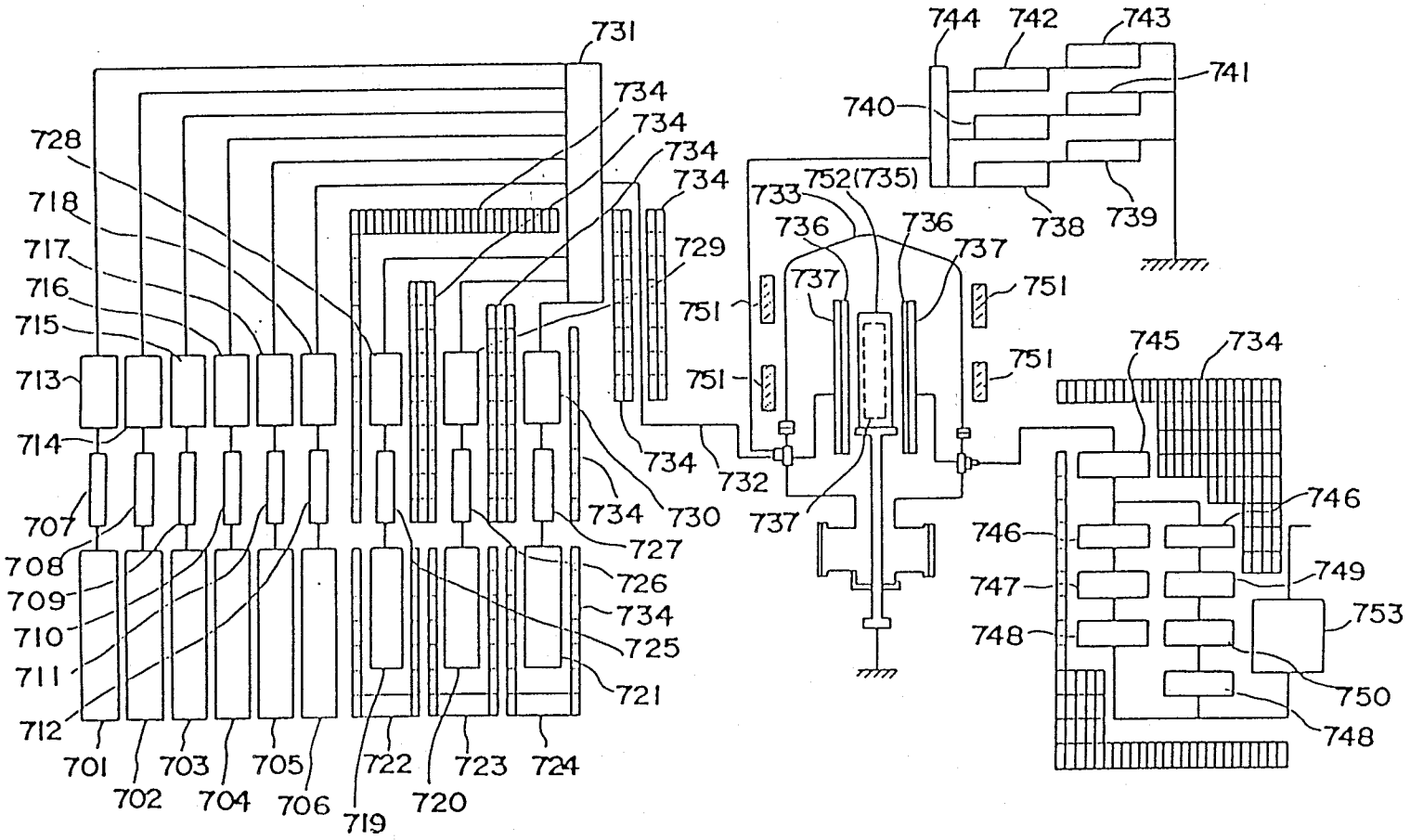

FIGS. 2 and 3 show examples of a glow discharge decomposition apparatus for forming the overcoating layer of the present invention. FIG. 2 shows a plane-parallel plate P-CVD apparatus and FIG. 3 shows a cylindrical P-CVD apparatus.

First, an explanation of the apparatus shown in FIG. 2 is set forth below.

FIG. 2 shows an apparatus for producing the surface protective layer, i.e., the a-C layer, for the photosensitive member of the present invention. The first to sixth tanks in the drawing have enclosed therein starting material compounds, which are in gas phase at room temperature, and a carrier gas, and are connected respectively to the first to sixth regulator valves 707 to 712 and first to sixth flow controllers 713 to 718. First to third containers 719 to 721 contain starting material compounds which are liquid or solid at room temperature, which can be preheated by first to third heaters 722 to 724 for vaporizing the compounds, and are connected to the seventh to ninth regulator valves 725 to 727 and the seventh to ninth flow controllers 728 to 730, respectively. The gases are mixed in a mixer 731 and fed to a reactor 733 via a main pipe 731. The interconnecting piping can be heated by a pipe heater 734 which is suitably disposed so that the material compound, in a liquid or solid phase at room temperature and vaporized by preheating, will not condense during transport. A grounded electrode 735 and a power electrode 736 are so arranged that they oppose each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740, and to a direct current power source 743 via a low-pass filter 742. Power of one of the different frequencies, for example, a low frequency of 1 kHz to 1,000 kHz, or a high frequency of 13.56 MHz and the like, is applicable to the electrode 736 by way of a connection selecting switch 744. Additionally, direct electrical power may also be applied.

According to the present invention, an amorphous hydrocarbon layer can be formed on an organic photosensitive layer with the substrate at a temperature of 100° C. or less by the impression of an alternating electric field having a frequency of at least 1 kHz to 1 MHz. The impression of power at a frequency in excess of 1 MHz produces powder and the amorphous hydrocarbon layer is not formed. The impression of power at a frequency less than 1 kHz prevents discharge and the amorphous hydrocarbon layer is not formed.

The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via the exhaust system selecting valve 746. The exhaust gas is further made harmless by a suitable removal device 753 and then released to the atmosphere. The evacuation piping system can also be heated by a suitably disposed pipe heater 734 so that compounds which are liquid or solid at room temperature, and vaporized by preheating, will not condense during transport. For the same reason, the reactor 733 can also be heated by a reactor heater 751. A substrate 752 is placed on the electrode in the reactor.

Heaters may be selected according to the characteristics of the starting material gases to be used, but they are often unnecessary, particularly when the vaporization point of the starting material gases under normal pressure is −50° C. to +15° C., thus allowing the simplification of the manufacturing apparatus.

In general, the provision of the aforesaid heater types is preferred in order to prevent production of a fine powder polymer within the reactor 733 when the vaporization point of the starting material gases is lower than −50° C., and to prevent coalescence within the various piping when the vaporization point of the starting material gases is higher than +15° C.

In FIG. 2, the substrate 752 has connected thereto a ground electrode 735, but a power impressing electrode 736 may similarly be connected thereto; the connection of both electrodes is also allowed.

FIG. 3 shows another type of apparatus for producing the surface protective layer, i.e., the a-C layer, of the photosensitive member of the invention. This apparatus has the same construction as the apparatus of FIG. 2 with the exception of the interior arrangement of the reactor 733. With reference to FIG. 3, the reactor 733 is internally provided with a hollow cylindrical substrate 752, serving also as the grounded electrode 735 of FIG. 2, and an electrode heater 737. A power application electrode 736, also in the form of a hollow cylinder, is provided around the substrate 752 and surrounded by the electrode heater 737. The conductive substrate 752 is rotatable about its own axis by an external drive motor 754.

According to the aforesaid construction, the reactor for preparing the photosensitive member is first evacuated by a diffusion pump to a vacuum of about $10^{-4}$ to about $10^{-6}$ torr, whereby the absorbed gas within the reactor is removed. The reactor is also checked for the degree of vacuum. At the same time, the electrodes and the substrate fixedly placed on the electrode are heated to a predetermined temperature by the electrode heater. In order to prevent heat conversion of the organic photosensitive layer at this time, it is desirable that the substrate temperature be set at 100° C. or less (room temperature to 100° C.). It is most desirable that the substrate be heated to about 40° to 60° C. in order to eliminate the influence of seasonal fluctuations in room temperature. A photosensitive member comprising a conductive substrate having a photosensitive layer provided thereon may be used.

Subsequently, material gases from the first through sixth tanks and first through third containers are fed into the reactor at a specified flow rate using the first to ninth flow controllers, and the interior of the reactor is maintained in a predetermined vacuum of about 0.05 to 5.0 torr by the pressure control valve. After the combined flow of gases has become stabilized, the low-frequency power source, for example, is selected by the connection selecting switch to apply a low-frequency power to the power application electrode. This initiates a discharge across the two electrodes, forming a solid amorphous hydrocarbon layer on the substrate with time. The layer deposition rate is 10 angstroms/min to 3 μm/min, with a range of 100 angstroms/min to 1 μm/min being preferably, and a range of 500 angstroms/min to 5000 angstroms/min being ideal. A layer deposition rate of less than 10 angstroms/min is undesirable from a production standpoint, while a rate greater than 3 μm/min is undesirable because it gives rise to layer unevenness. The discharge is terminated when the layer reaches a specified thickness and a photosensitive member of the present invention is thus obtained.

A photosensitive member overcoating layer of the present invention manufactured by the aforesaid process is clearly non-crystalline, as determined by the peak x-ray diffraction, and contains carbon as well as hydrogen as structural atoms as determined by the peak infrared absorption based on the absorption spectrum of the carbon and hydrogen bonds. Said layer is thus understood to be an amorphous hydrocarbon layer.

Furthermore, the peak infrared absorption, for a photosensitive member overcoating layer of the present invention manufactured by the aforesaid process, may also measure the content of halogen, nitrogen or oxygen, and carbon bonds via the infrared absorption spectrum.

It is preferred that a photosensitive member overcoating layer of the present invention have a dielectric constant of about 2.0 to 6.0, with an optical band gap of about 1.5 to 3.0 [eV].

The present invention is hereinafter explained by means of actual examples.

First, the organic photosensitive layers A through I were manufactured. Hereafter, photosensitive layers formed on an aluminum plate substrate measuring 50 mm in length, 50 mm in width and 3 mm in thickness have the supplementary designation "p" and are thus labeled organic photosensitive layers Ap to Ip. Likewise, photosensitive layers formed on a cylindrical aluminum substrate measuring 80 mm in diameter and 330 mm in length have the supplementary designation "d" and are thus labeled organic photosensitive layers Ad to Id.

Manufacture Of Organic Photosensitive Layer A

A fluid mixture of one part by weight of chlorodian blue (CDB) as a dis-azo pigment, one part polyester resin (Toyobo Co, V-200), and one hundred parts cyclohexanone are dispersed in a sand grinder for 13 min. A cylindrical aluminum substrate measuring 80 by 330 mm is dipped in the fluid dispersion, so as to be coated with a 0.3 μm thick film after drying, said film is then dried to form the charge transporting layer.

Next, one part by weight of 4-diethylaminobenzaldehyde diphenylhydrazone (DEH) and one part polycarbonate (Teijin Kasei Co., K-1300) are dissolved in six parts by weight of THF, and the solution is applied over the conductive layer so as to form a layer of 15 μm thickness after drying, said application is then dried forming a charge transporting layer. An organic photosensitive layer Ad is thus obtained. An organic photosensitive layer Ap is formed on a 50×50×3 mm aluminum plate substrate by means of an identical process.

Comparative Example 1

The organic photosensitive layers Ad and Ap obtained by the previously described process were subjected to an initial charge of −600 V (hereinafter referred to as Vo) using the corona discharge during the normal Carlson process. The measured amount of light required to reduce the surface potential by half (hereinafter referred to as $E_{\frac{1}{2}}$) was 2.0 lux-sec, and the residual potential (hereinafter referred to as Vr) was −5 V. Also, the organic photosensitive layers of Example 1 had a surface hardness ratings of approximately 5B based on measurements for pencil lead hardness as provided in Japanese Industrial Standards JIS K-5400. When the photosensitive members obtained in Example 1 were installed in actual copying machines (Minolta Model EP470Z) and subjected to resistance tests comprising the making of 10,000 A4 size copies, a loss of layer thickness of approximately 2.0 μm was observed.

From these results it can be understood that although the organic photosensitive member overcoating layer of the present invention was observed to possess superior electrostatic characteristics, the member was observed to be poor in durability.

Manufacture Of Organic Photosensitive Layer B

Organic photosensitive layers Bd and Bp were manufactured in substantially the same manner as were layers Ad and Ap with the exception of substituting methyl methacrylate PMMA (Mitsubishi Rayon Co., BR-85) for the polycarbonate used to form the charge transporting layer.

Comparative Example 2

Evaluations of the organic photosensitive layers Bd and Bp were conducted using the same criteria as for Comparative Example 1; the results are shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer C

Organic photosensitive layers Cd and Cp were manufactured in substantially the same manner as layers Ad and Ap with the exception of substituting polyarylate (Yunichika Co., U-4000) for the polycarbonate.

Comparative Example 3

Evaluation of the organic photosensitive layers Cd and Cp were conducted using the same criteria as for Comparative Example 1; the results are shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer D

Organic photosensitive layers Dd and Dp were manufactured in substantially the same manner as layers Ad and Ap with the exception of substituting polyester (Toyobo Co., V-200) for the polycarbonate.

Comparative Example 4

Evaluations of the organic photosensitive layers Dd and Dp were conducted using the same criteria as for Comparative Example 1 with the results shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer E

A fluid mixture of 25 parts by weight of a specific α-type copper phthalocyanine (Toyo Ink Co.), 50 parts acrylmelamine thermosetting resin (Dainippon Ink Co., a mixture of A-405 and Super Bekkamin J-8200), 25 parts 4-diethylaminobenzaldehyde diphenylhydrazone, and 500 parts organic solvent (a mixture of 7 parts xylene and 3 parts butanol) is pulverized and dispersed in a ball mill for 10 hr. A cylindrical aluminum substrate measuring 80 mm in diameter and 330 mm in length is dipped in this fluid dispersion so as to be coated with a film having a thickness of 15 μm after drying, said film is then baked 1 hr at 150° C., whereby the organic photosensitive layer Ed is obtained. An organic photosensitive layer Ep is formed on a 50×50×3 mm aluminum plate substrate by means of an identical process.

Comparative Example 5

Evaluations of the organic photosensitive layers Ed and Ep were conducted using the same criteria as for Comparative Example 1 with the results shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer F

A fluid dispersion of 2 parts dis-azo compound (G-1) as shown in Table 2-1, 1 part polyester resin (Toyobo Co., V-500), and 100 parts methyl ethyl ketone, is subjected to a dispersion process using a ball mill for 24 hr. A cylindrical aluminum substrate measuring 80 mm in diameter by 330 mm in length is coated with this fluid dispersion via a dipping process so as to form a film layer having a thickness of 3,000 angstroms, thereby forming a charge producing layer.

Next, a coating comprising 10 parts hydrazone compound (T-1) as shown in Table 2-2 and 10 parts polycarbonate resin (Teijin Kasei Co., K-1300) dissolved in 80 parts tetrahydrofuran is applied to the charge producing layer so as to form a layer having a thickness of 20 μm after drying, said layer then being dried to form a charge transporting layer, thereby forming the organic photosensitive layer Fd. An organic photosensitive layer Fp is formed on a 50×50×3 mm aluminum plate substrate by means of an identical process.

Comparative Example 6

Evaluations of the organic photosensitive layers Fd and Fp were conducted using the same criteria as for Comparative Example 1 with the results shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer G

A fluid dispersion of 2 parts dis-azo compound (G-2) as shown in Table 2-1, 1 part polyester resin (Toyobo Co., V-500), and 100 parts methyl ethyl ketone is subjected to a dispersion process using a ball mill for 24 hr. A cylindrical aluminum substrate measuring 80 mm in diameter by 330 mm in length is coated with this fluid dispersion via a dipping process so as to form a film layer having a thickness of 2,500 angstroms, thereby forming a charge producing layer.

Next, a coating comprising 10 parts of a stilbene compound (T-2), as shown in Table 2-2, and 10 parts polyarylate resin (Unichika Co., U-4000) dissolved in 85 parts tetrahydrofuran is applied to the charge producing layer so as to form a layer having a thickness of 20 μm after drying, said layer then is dried to form a charge transporting layer, thereby forming the organic photosensitive layer Gd. An organic photosensitive layer Gp is formed on a 50×50×3 mm aluminum plate substrate by means of an identical process.

Comparative Example 7

Evaluations of the organic photosensitive layers Gd and Gp were conducted using the same criteria as for Comparative Example 1 with the results shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer H

A fluid dispersion of 2 parts dis-azo compound (G-3) as shown in Table 2-1, 1 part polyester resin (Toyobo Co., V-500), and 100 parts methyl ethyl ketone is subjected to a dispersion process using a ball mill for 24 hr. A cylindrical aluminum substrate measuring 80 mm in diameter by 330 mm in length is coated with this fluid dispersion via a dipping process so as to form a film layer having a thickness of 3,000 angstroms, thereby forming a charge producing layer.

Next, a coating comprising 10 parts of a stilbene compound (T-3), as shown in Table 2-2, and 10 parts methyl methacrylate resin (Mitsubishi Rayon, BR-85) dissolved in 80 parts tetrahydrofuran, is applied to the charge producing layer so as to form a layer having a thickness of 20 μm after drying, said layer then being dried to form a charge transporting layer, thereby forming an organic photosensitive layer Hd. An organic photosensitive layer Hp is formed on a 50×50×3 mm aluminum plate substrate by means of an identical process.

Comparative Example 8

Evaluations of the organic photosensitive layers Hd and Hp were conducted using the same criteria as for Comparative Example 1 with the results shown in Table 1.

From these results it can be understood that although the organic photosensitive member overcoating layer of the present invention was observed to possess superior electrostatic characteristics, the member was observed to be poor in durability.

Manufacture Of Organic Photosensitive Layer I

Titanylphthalocyanine (TiOPc) undergoes vacuum deposition using a heat resistance process at a boat temperature of approximately 400° to 500° C. in a vacuum of $10^{-4}$ to $10^{-6}$ torr, with the resulting TiOPc deposition film having a thickness of 2,500 angstroms forming a charge producing layer.

Then, 1 part p,p-bisdiethylaminotetraphenylbutadiene, having the chemical structure shown hereinafter in [A], and 1 part polycarbonate (Teijin Kasei Co., K-1300) are dissolved in 6 parts THF6, and a coating of the solution is applied to the aforesaid charge producing layer so as to form a film having a thickness of 15 μm after drying, said film then being dried to form a charge transporting layer, thereby forming an organic photosensitive layer Id. An organic photosensitive layer Ip is formed on a 50×50×3 mm aluminum plate substrate by means of an identical process.

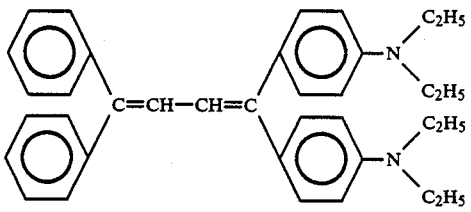

[A]

Comparative Example 9

The organic photosensitive layers Id and Ip obtained by the previously described process were subjected to an initial charge Vo of −600 V using the corona discharge during the normal Carlson process. The amount of light required to reduce the surface potential by half ($E_{\frac{1}{2}}$) was measured using a semiconductor laser with a light wavelength of 780 nm with the $E_{\frac{1}{2}}$ equalling 4.9 ergs/cm$^2$, and the residual potential Vr was −5 V. Also, the organic photosensitive layers of Comparative Example 9 had surface hardness ratings of approximately 5B based on measurements for pencil lead hardness as provided in Japanese Industrial Standards JIS K-5400. When these photosensitive members obtained in Example 9 were installed in actual copying machines (Minolta Model EP470Z with the optical system modified with a polygon mirror scanning-type semiconductor laser) and subjected to resistance tests comprising the making of 10,000 A4 size copies, a loss of layer thickness of approximately 2.0 μm was observed. From these results it can be understood that although the organic photosensitive member overcoating layer of the present invention was observed to possess superior electrostatic characteristics, the member was observed to be poor in durability.

The results are shown in Table 1. The use of semiconductor laser light as an exposure light source is indicated by the [*] mark next to the $E_{\frac{1}{2}}$ value [erg/cm$^2$].

TABLE 1

| Comparative Example | Vo [V] | $E_{\frac{1}{2}}$ [lux-sec] | Vr [V] | Hardness | Film Loss [μm] |
|---|---|---|---|---|---|
| Ex. 1 | −600 | 2.0 | −5 | 5B | 2.0 |
| Ex. 2 | −600 | 6.2 | −12 | B | 1.3 |
| Ex. 3 | −600 | 2.3 | −8 | B | 2.5 |
| Ex. 4 | −600 | 2.2 | −7 | 5B | 2.0 |
| Ex. 5 | +600 | 4.3 | +5 | B | 1.0 |
| Ex. 6 | −600 | 1.8 | −5 | B | 2.0 |
| Ex. 7 | −600 | 1.0 | −4 | 5B | 1.8 |
| Ex. 8 | −600 | 2.1 | −7 | 5B | 2.2 |
| Ex. 9 | −600 | 4.9* | −5 | 5B | 2.0 |

(The [*] mark indicates data for semiconductor laser light [erg/cm$^2$]
(Evaluations conducted for layer loss after 10,000 printings.)

TABLE 2-1

Charge Producing Materials

G-1

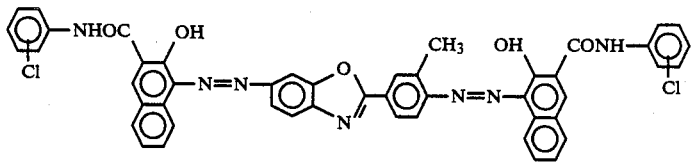

G-2

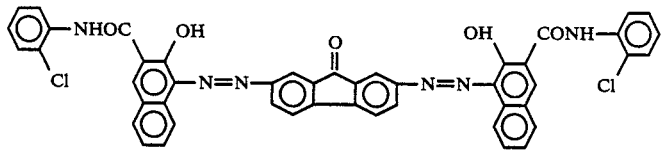

G-3

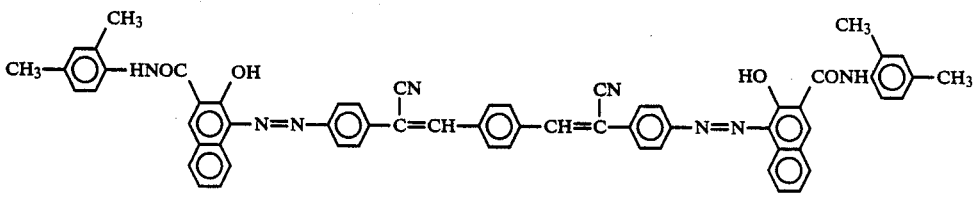

Charge Transporting Materials

T-1

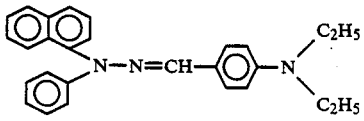

T-2

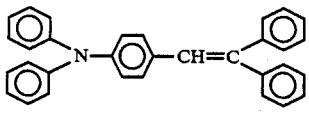

TABLE 2-1-continued

| | |
|---|---|
| T-3 | 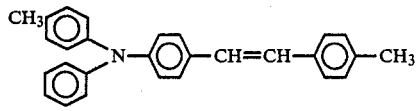 |

EXAMPLE 1

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and third regulator valves 707, 708 and 709 were thereafter opened to introduce hydrogen gas from the first tank 701, ethylene gas from the second tank 702, and nitrogen gas from the third tank 703 into the first, second and third flow controllers 713, 714 and 715, respectively, each at an output pressure of 1.0 kg/cm$^2$. The dials on the flow controllers were adjusted to supply the hydrogen gas at a flow rate of 40 sccm, the ethylene gas at 30 sccm, and the nitrogen gas at 30 sccm, to the reactor 733 through the main pipe 732 via the intermediate mixer 731. Following stabilization of each gas flow, the internal pressure of the reactor 733 was adjusted to 0.5 torr by the pressure control valve 745. On the other hand, the organic photosensitive layer Ap was used as the substrate 752, said substrate being preheated to a temperature of 100° C. With the gas flow rates and the pressure in stabilized states, 200-watt power with a frequency of 13.56 MHz was applied to the power application electrode 736 from the high-frequency power source 739 preconnected thereto by the selecting switch 744 to conduct plasma polymerization for approximately 10 min, forming an a-C layer, i.e. an overcoating layer, 0.32 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 47 atomic % of hydrogen atoms based on the combined amount of hydrogen and carbon atoms, and under Auger electron spectroscopy the layer was found to contain approximately 1.3 atomic % of nitrogen atoms based on the atoms of the entire structure.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.1 lux-sec and the residual potential Vr was 5 V. From these data it is understood that the photosensitive member overcoating layer of the present invention does not impair the inherently superior sensitivity of the organic photosensitive layer. Furthermore, the overcoating layer obtained in Example 1 had a surface hardness of 7H and higher based on measurements for pencil lead hardness as provided in Japanese Industrial Standards JIS K-5400, and it is understood that the high degree of surface hardness was a marked improvement.

EXAMPLE 2

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 3, first, the interior of the reactor 733 was evacuated to a high vacuum of approximately $10^{-6}$ torr, and the first, second and third regulator valves 707, 708 and 709 were thereafter opened to introduce hydrogen gas from the first tank 701, ethylene gas from the second tank 702, and nitrogen gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 120 sccm, the ethylene gas at 90 sccm, and the nitrogen gas at 65 sccm, to the reactor 733 through the main pipe 732 via the intermediate mixer 731. Following stabilization of each gas flow, the internal pressure of the reactor 733 was adjusted to 0.8 torr by the pressure control valve 745. On the other hand, the organic photosensitive layer Ad was used as the substrate 752, said substrate being preheated to a temperature of 75° C. With the gas flow rates and the pressure in stabilized states, 250-watt power with a frequency of 13.56 MHz was applied to the power application electrode 736 from the high-frequency power source 739 preconnected thereto by the selecting switch 744 to conduct plasma polymerization for approximately 5 min, forming an a-C layer, i.e. an overcoating layer, 0.2 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 31 atomic % of hydrogen atoms based on the combined amount of hydrogen and carbon atoms, and under Auger electron spectroscopy the layer was found to contain approximately 2.1 atomic % of nitrogen atoms based on the atoms of the entire structure.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.0 lux-sec and the residual potential Vr was 7 V. From these data it is understood that the photosensitive member overcoating layer of the present invention does not impair the inherently superior sensitivity of the organic photosensitive layer. Furthermore, the overcoating layer obtained in Example 2 had a surface hardness of 7H and higher based on measurements for pencil lead hardness as provided in Japanese Industrial Standards JIS K-5400, and it is understood that the high degree of surface hardness was a marked improvement.

In addition, when the photosensitive member of the invention obtained in Example 2 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 3

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and nitrogen gas from the second tank 702 at an output pressure of 1.0 $Kg/cm^2$, and styrene gas from the first container 719 heated to a temperature of 35° C. by first heater 722 into the first, second and seventh flow controllers 713, 714 and 728, respectively. The dials on the flow controllers were adjusted to supply the hydrogen gas at a flow rate of 40 sccm, the nitrogen gas at 3 sccm, and the styrene gas at 10 sccm, to the reactor 733 through the main pipe 732 via the intermediate mixer 731. Following stabilization of each gas flow, the internal pressure of the reactor 733 was adjusted to 0.25 torr by the pressure control valve 745. On the other hand, the organic photosensitive layer Bp was used as the substrate 752, said substrate being preheated to a temperature of 35° C. With the gas flow rates and the pressure in stabilized states, 120-watt power with a frequency of 100 KHz was applied to the power application electrode 736 from the low-frequency power source 741 preconnected thereto by the selecting switch 744 to conduct plasma polymerization for approximately 45 s, forming an a-C layer, i.e. an overcoating layer, 0.5 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 41 atomic % of hydrogen atoms based on the combined amount of hydrogen and carbon atoms, and under Auger electron spectroscopy the layer was found to contain approximately 0.15 atomic % of nitrogen atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 6.2 lux-sec and the residual potential Vr was 11 V. From these data it is understood that the photosensitive member overcoating layer of the present invention does not impair the inherently superior sensitivity of the organic photosensitive layer. Furthermore, the overcoating layer obtained in Example 3 had a surface hardness about 7 H based on measurements for pencil lead hardness as provided in Japanese Industrial Standards JIS K-5400, and it is understood that the high degree of surface hardness was a marked improvement.

EXAMPLE 4

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 3, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and nitrogen gas from the second tank 702 at an output pressure of 1.0 $Kg/cm^2$, and styrene gas from the first container 719 heated to a temperature of 45° C. by first heater 722 into the first, second and seventh flow controllers 713, 714 and 728, respectively. The dials on the flow controllers were adjusted to supply the hydrogen gas at a flow rate of 90 sccm, the nitrogen gas at 30 sccm, and the styrene gas at 18 sccm, to the reactor 733 through the main pipe 732 via the intermediate mixer 731. Following stabilization of each gas flow, the internal pressure of the reactor 733 was adjusted to 0.28 torr by the pressure control valve 745. On the other hand, the organic photosensitive layer Bd was used as the substrate 752, said substrate being at normal temperature. With the gas flow rates and the pressure in stabilized states, 200-watt power with a frequency of 150 KHz was applied to the power application electrode 736 from the low-frequency power source 741 pre-connected thereto by the selecting switch 744 to conduct plasma polymerization for approximately 50 s, forming an a-C layer, i.e. an overcoating layer, 1 μm thick on the substrate 752. After completion of the film formation, the power supply was discontinued, the regulator valves were closed and the reactor 733 was fully exhausted, whereupon the vacuum was broken and the photosensitive member of the present invention was removed.

When subjected to CHN quantitative analysis, the a-C layer thus obtained was found to contain 47 atomic % of hydrogen atoms based on the combined amount of hydrogen and carbon atoms, and under Auger electron spectroscopy the layer was found to contain approximately 1.4 atomic % of nitrogen atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 6.4 lux-sec and the residual potential Vr was 10 V. From these data it is understood that the photosensitive member overcoating layer of the present invention does not impair the inherently superior sensitivity of the organic photosensitive layer. Furthermore, the overcoating layer obtained in Example 4 had a surface hardness of 7

H and greater based on measurements for pencil lead hardness as provided in Japanese Industrial Standards JIS K-5400, and it is understood that the high degree of surface hardness was a marked improvement.

In addition, when the photosensitive member of the invention obtained in Example 4 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 5

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and butadiene gas from the second tank 702 at an output pressure of 1.0 $Kg/cm^2$, and diethylamine gas from the first container 719 heated to a temperature of 40° C. by first heater 722 into the first, second and seventh flow controllers 713, 714 and 728, respectively. The dials on the flow controllers were adjusted to supply the hydrogen gas at a flow rate of 60 sccm, the butadiene gas at 60 sccm, and the diethylamine gas at 25 sccm, to the reactor 733 through the main pipe 732 via the intermediate mixer 731. Following stabilization of each gas flow, the internal pressure of the reactor 733 was adjusted to 0.5 torr by the pressure control valve 745. On the other hand, the organic photosensitive layer Cp was used as the substrate 752, said substrate being preheated to a temperature of 45° C. With the gas flow rates and the pressure in stabilized states, 100-watt power with a frequency of 100 KHz was applied to the power application electrode 736 from the low-frequency power source 741 pre-connected thereto by the selecting switch 744 to conduct plasma polymerization for approximately 25 s, forming an a-C layer, i.e. an overcoating layer, 0.5 μm thick on the substrate 752. After completion of the film formation, the power supply was discontinued, the regulator valves were closed, and the reactor 733 was fully exhausted, whereupon the vacuum was broken and the photosensitive member of the present invention was removed.

When subjected to CHN quantitative analysis, the a-C layer thus obtained was found to contain about 36 atomic % of hydrogen atoms based on the combined amount of hydrogen and carbon atoms, and under Auger electron spectroscopy the layer was found to contain approximately 18 atomic % of nitrogen atoms based on the atoms of the entire structure.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.4 lux-sec and the residual potential Vr was 10 V. From these data it is understood that the photosensitive member overcoating layer of the present invention does not impair the inherently superior sensitivity of the organic photosensitive layer. Furthermore, the overcoating layer obtained in Example 5 had a surface hardness about 7 H based on measurements for pencil lead hardness as provided in Japanese Industrial Standards JIS K-5400, and it is understood that the high degree of surface hardness was a marked improvement.

EXAMPLE 6

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 3, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and butadiene gas from the second tank 702 at an output pressure of 1.0 $Kg/cm^2$, and diethylamine gas from the first container 719 heated to a temperature of 45° C. by first heater 722 into the first, second and seventh flow controllers 713, 714 and 728, respectively. The dials on the flow controllers were adjusted to supply the hydrogen gas at a flow rate of 200 sccm, the butadiene gas at 30 sccm, and the diethylamine gas at 40 sccm, to the reactor 733 through the main pipe 732 via the intermediate mixer 731. Following stabilization of each gas flow, the internal pressure of the reactor 733 was adjusted to 0.7 torr by the pressure control valve 745. On the other hand, the organic photosensitive layer Cd was used as the substrate 752, said substrate being preheated to a temperature of 30° C. With the gas flow rates and the pressure in stabilized states, 250-watt power with a frequency of 120 KHz was applied to the power application electrode 736 from the low-frequency power source 741 pre-connected thereto by the selecting switch 744 to conduct plasma polymerization for approximately 30 s, forming an a-C layer, i.e. an overcoating layer, 2.2 μm in thickness on the substrate 752. After completion of the film formation, the power supply was discontinued, the regulator valves were closed, and the reactor 733 was fully exhausted, whereupon the vacuum was broken and the photosensitive member of the present invention was removed.

When subjected to CHN quantitative analysis, the a-C layer thus obtained was found to contain about 38 atomic % of hydrogen atoms based on the combined amount of hydrogen and carbon atoms, and under Auger electron spectroscopy the layer was found to contain approximately 20 atomic % of nitrogen atoms based on the atoms of the entire structure.

Characteristics:

The photosensitive member of the invention thus obtained was charged at −600 V and one half the surface potential $E_{\frac{1}{2}}$ was measured using the corona discharge from a normal Carlson process; the $E\frac{1}{2}$ was 2.3 lux-sec and the residual potential Vr was 9 V. From these data it is understood that the photosensitive member overcoating layer of the present invention does not impair the inherently superior sensitivity of the organic photosensitive layer. Furthermore, the overcoating layer obtained in Example 6 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 6 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 7

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and ammonia gas from the second tank 702 at an output pressure of 1.0 Kg/cm$^2$, and myrcene gas from the first container 719 heated to a temperature of 45° C. by first heater 722 into the first, second and seventh flow controllers 713, 714 and 728, respectively. The dials on the flow controllers were adjusted to supply the hydrogen gas at a flow rate of 40 sccm, the ammonia gas at 0.5 sccm, and the myrcene gas at 15 sccm, to the reactor 733 through the main pipe 732 via the intermediate mixer 731. Following stabilization of each gas flow, the internal pressure of the reactor 733 was adjusted to 0.23 torr by the pressure control valve 745. On the other hand, the organic photosensitive layer Dp was used as the substrate 752, said substrate being at normal temperature. With the gas flow rates and the pressure in stabilized states, 150-watt power with a frequency of 80 KHz was applied to the power application electrode 736 from the low-frequency power source 741 pre-connected thereto by the selecting switch 744 to conduct plasma polymerization for approximately 20 s, forming an a-C layer, i.e. an overcoating layer, 0.2 μm thick on the substrate 752. After completion of the film formation, the power supply was discontinued, the regulator valves were closed, and the reactor 733 was fully exhausted, whereupon the vacuum was broken and the photosensitive member of the present invention was removed.

When subjected to CHN quantitative analysis, the a-C layer thus obtained was found to contain about 56 atomic % of hydrogen atoms based on the combined amount of hydrogen and carbon atoms, and under Auger electron spectroscopy the layer was found to contain approximately 3 atomic % of nitrogen atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.3 lux-sec and the residual potential Vr was 7 V. From these data it is understood that the photosensitive member overcoating layer of the present invention does not impair the inherently superior sensitivity of the organic photosensitive layer. Furthermore, the overcoating layer obtained in Example 7 had a surface hardness of 7 H and greater based on measurements for pencil lead hardness as provided in Japanese Industrial Standards JIS K-5400, and it is understood that the high degree of surface hardness was a marked improvement.

EXAMPLE 8

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 3, first, the interior of the reactor 733 was evacuated to a high vacuum of approximately $10^{-6}$ torr, and the first, second and seventh regulator valves 707, 708 and 725 were thereafter opened to introduce argon gas from the first tank 701 and nitrous oxide gas from the second tank 702 at an output pressure of 1.0 Kg/cm$^2$, and myrcene gas from the first container 719 heated to a temperature of 145° C. by first heater 722 into the first, second and seventh flow controllers 713, 714 and 728, respectively. The dials on the flow controllers were adjusted to supply the argon gas at a flow rate of 40 sccm, the nitrous oxide gas at 8 sccm, and the myrcene gas at 30 sccm, to the reactor 733 through the main pipe 732 via the intermediate mixer 731. Following stabilization of each gas flow, the internal pressure of the reactor 733 was adjusted to 0.25 torr by the pressure control valve 745. On the other hand, the organic photosensitive layer Dd was used as the substrate 752, said substrate being at normal temperature. With the gas flow rates and the pressure in stabilized states, 130-watt power with a frequency of 150 KHz was applied to the power application electrode 736 from the low-frequency power source 741 pre-connected thereto by the selecting switch 744 to conduct plasma polymerization for approximately 20 s, forming an a-C layer, i.e. an overcoating layer, 0.3 μm thick on the substrate 752. After completion of the film formation, the power supply was discontinued, the regulator valves were closed, and the reactor 733 was fully exhausted, whereupon the vacuum was broken and the photosensitive member of the present invention was removed.

When subjected to CHN quantitative analysis, the a-C layer thus obtained was found to contain about 55 atomic % of hydrogen atoms based on the combined amount of hydrogen and carbon atoms, and under Auger electron spectroscopy the layer was found to contain approximately 1.8 atomic % of nitrogen atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.2 lux-sec and the residual potential Vr was 8 V. From these data it is understood that the photosensitive member overcoating layer of the present invention does not impair the inherently superior sensitivity of the organic photosensitive layer. Furthermore, the overcoating layer obtained in Example 8 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 8 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 9

A photosensitive member having a 0.3 μm overcoating layer of the present invention was formed in substantially the same manner as in Example 1 with the exception of substituting carbon dioxide gas for the nitrogen gas. The amount of oxygen atoms contained in the resulting a-C layer was approximately 1.5 atomic % based on the atoms of the entire structure, with the amount of other atoms being identical with the results of Example 1.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.0 lux-sec and the residual potential Vr was 5 V. From these data it is understood that the photosensitive member overcoating layer of the present invention does not impair the inherently superior sensitivity of the organic photosensitive layer. Furthermore, the overcoating layer obtained in Example 9 had a surface hardness of 7 H and greater based on measurements for pencil lead hardness as provided in Japanese Industrial Standards JIS K-5400, and it is understood that the high degree of surface hardness was a marked improvement.

EXAMPLE 10

A photosensitive member having a 0.23 μm overcoating layer of the present invention was formed in substantially the same manner as in Example 2 with the exception of substituting carbon dioxide gas for the nitrogen gas. The amount of oxygen atoms contained in the resulting a-C layer was approximately 2.1 atomic % based on the atoms of the entire structure, with the amount of hydrogen atoms being about 33 atomic % of the combined amount of hydrogen and carbon atoms.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.1 lux-sec and the residual potential Vr was 8 V. From these data it is understood that the photosensitive member overcoating layer of the present invention does not impair the inherently superior sensitivity of the organic photosensitive layer. Furthermore, the overcoating layer obtained in Example 10 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 10 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 11

A photosensitive member having a overcoating layer of the present invention was formed in substantially the same manner as in Example 3 with the exception of substituting carbon dioxide gas at 2.5 sccm for the nitrogen gas. The amount of oxygen atoms contained in the resulting a-C layer was approximately 0.1 atomic % based on the atoms of the entire structure, with the amount of hydrogen atoms being about 43 atomic % of the combined amount of hydrogen and carbon atoms.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 6.3 lux-sec and the residual potential Vr was 10 V. From these data it is understood that the photosensitive member overcoating layer of the present invention does not impair the inherently superior sensitivity of the organic photosensitive layer. Furthermore, the overcoating layer obtained in Example 11 had a surface hardness of approximately 7 H based on measurements for pencil lead hardness as provided in Japanese Industrial Standards JIS K-5400, and it is understood that the high degree of surface hardness was a marked improvement.

EXAMPLE 12

A photosensitive member having a overcoating layer of the present invention was formed in substantially the same manner as in Example 4 with the exception of substituting carbon dioxide gas for the nitrogen gas. The amount of oxygen atoms contained in the resulting a-C layer was approximately 1.0 atomic % based on the atoms of the entire structure, with the amount of hydrogen atoms being about 45 atomic % of the combined amount of hydrogen and carbon atoms.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 6.4 lux-sec and the residual potential Vr was 12 V. From these data it is understood that the photosensitive member overcoating layer of the present invention does not impair the inherently superior sensitivity of the organic photosensitive layer. Furthermore, the overcoating layer obtained in Example 12 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 12 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 13

A photosensitive member of the present invention sequentially comprising a conductive substrate, an organic photosensitive layer and an overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and seventh regulator valves 707, 708 and 725 were thereafter opened to introduce hydrogen gas from the first tank 701 and butadiene gas from the second tank 702 at an output pressure of 1.0 Kg/cm$^2$, and methanol gas from the first container 719 heated to a temperature of 35° C. by first heater 722 into the first, second and seventh flow controllers 713, 714 and 728, respectively. The dials on the flow controllers were adjusted to supply the hydrogen gas at a flow rate of 60 sccm, the butadiene gas at 60 sccm, and the methanol gas at 25 sccm, to the reactor 733 through the main pipe 732 via the intermediate mixer 731. Following stabilization of each gas flow, the internal pressure of the reactor 733 was adjusted to 0.4 torr by the pressure control valve 745. On the other hand, the organic photosensitive layer Cp was used as the substrate 752, said substrate being preheated to a temperature of 30° C. With the gas flow rates and the pressure in stabilized states, 100-watt power with a frequency of 100 KHz was applied to the power application electrode 736 from the low-frequency power source 739 pre-connected thereto by the selecting switch 744 to conduct plasma polymerization for approximately 25 s, forming an a-C layer, i.e. an overcoating layer, 0.7 μm thick on the substrate 752. After completion of the film formation, the power supply was discontinued, the regulator valves were closed, and the reactor 733 was fully exhausted, whereupon the vacuum was broken and the photosensitive member of the present invention was removed.

When subjected to CHN quantitative analysis, the a-C layer thus obtained was found to contain about 36 atomic % of hydrogen atoms based on the combined amount of hydrogen and carbon atoms, and under Auger electron spectroscopy the layer was found to contain approximately 12 atomic % of oxygen atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.4 lux-sec and the residual potential Vr was 8 V. From these data it is understood that the photosensitive member overcoating layer of the present invention does not impair the inherently superior sensitivity of the organic photosensitive layer. Furthermore, the overcoating layer obtained in Example 13 had a surface hardness of 7 H and greater based on measurements for pencil lead hardness as provided in Japanese Industrial Standards JIS K-5400, and it is understood that the high degree of surface hardness was a marked improvement.

EXAMPLE 14

A photosensitive member having a 2.0 μm overcoating layer of the present invention was formed in substantially the same manner as for Example 6 with the exception of substituting ethanol gas heated by the first heater to a temperature of 40° C. for the diethylamine gas. The amount of oxygen atoms contained in the resulting a-C layer was approximately 21 atomic % based on the atoms of the entire structure, with the amount of other atoms being identical with the results of Example 6.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.3 lux-sec and the residual potential Vr was 10 V. From these data it is understood that the photosensitive member overcoating layer of the present invention does not impair the inherently superior sensitivity of the organic photosensitive layer. Furthermore, the overcoating layer obtained in Example 14 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 14 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 15

A photosensitive member having a 0.25 μm overcoating layer of the present invention was formed in substantially the same manner as in Example 7 with the exception of substituting nitrous oxide gas at 2 sccm for the ammonia gas. The amount of oxygen atoms contained in the resulting a-C layer was approximately 3 atomic % and the amount of nitrogen atoms was approximately 5.4% based on the atoms of the entire structure, with the amount of other atoms being identical with the results of Example 7.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.3 lux-sec and the residual potential Vr was 7 V. From these data it is understood that the photosensitive member overcoating layer of the present invention does not impair the inherently superior sensitivity of the organic photosensitive layer. Furthermore, the overcoating layer obtained in Example 15 had a surface hardness of 7 H and greater based on measurements for pencil lead hardness as provided in Japanese Industrial Standards JIS K-5400, and it is understood that the high degree of surface hardness was a marked improvement.

EXAMPLE 16

A photosensitive member having an overcoating layer of the present invention was formed in substantially the same manner as in Example 1 with the exception of substituting carbon tetrafluoride gas for the nitrogen gas. The amount of halogen atoms, i.e. fluorine atoms, contained in the resulting a-C layer was approximately 1.8 atomic % based on the atoms of the entire structure, with the amount of other atoms being identical with the results of Example 1.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.1 lux-sec and the residual potential Vr was 6 V. From these data it is understood that the photosensitive member overcoating layer of the present invention does not impair the inherently superior sensitivity of the organic photosensitive layer. Furthermore, the overcoating layer obtained in Example 16 had a surface hardness of 7 H and greater based on measurements for pencil lead hardness as provided in Japanese Industrial Standards JIS K-5400, and it is understood that the high degree of surface hardness was a marked improvement.

EXAMPLE 17

A photosensitive member having an overcoating layer of the present invention was formed in substantially the same manner as in Example 2 with the exception of substituting carbon tetrafluoride gas for the nitrogen gas. The amount of halogen atoms, i.e. fluorine atoms, contained in the resulting a-C layer was approximately 2.3 atomic % based on the atoms of the entire structure, with the amount of other atoms being identical with the results of Example 2.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.0 lux-sec and the residual potential Vr was 8 V. From these data it is understood that the photosensitive member overcoating layer of the present invention does not impair the inherently superior sensitivity of the organic photosensitive layer. Furthermore, the overcoating layer obtained in Example 17 had a surface hardness of approximately 7 H based on measurements for pencil lead hardness as provided in Japanese Industrial Standards JIS K-5400, and it is understood that the high degree of surface hardness was a marked improvement.

In addition, when the photosensitive member of the invention obtained in Example 17 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 18

A photosensitive member having an overcoating layer of the present invention was formed in substantially the same manner as in Example 3 with the exception of substituting carbon tetrafluoride gas at 2 sccm for the nitrogen gas introduced to the substrate which was preheated to a temperature of 40° C. The amount of halogen atoms, i.e. fluorine atoms, contained in the resulting a-C layer was approximately 0.1 atomic % based on the atoms of the entire structure, with the amount of other atoms being identical with the results of Example 3.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 6.4 lux-sec and the residual potential Vr was 11 V. From these data it is understood that the photosensitive member overcoating layer of the present invention does not impair the inherently superior sensitivity of the organic photosensitive layer. Furthermore, the overcoating layer obtained in Example 18 had a surface hardness of approximately 7 H based on measurements for pencil lead hardness as provided in Japanese Industrial Standards JIS K-5400, and it is understood that the high degree of surface hardness was a marked improvement.

EXAMPLE 19

A photosensitive member having an overcoating layer of the present invention was formed in substantially the same manner as in Example 4 with the exception of substituting carbon tetrafluoride gas for the nitrogen gas. The amount of halogen atoms, i.e. fluorine atoms, contained in the resulting a-C layer was approximately 1.1 atomic % based on the atoms of the entire structure, with the amount of other atoms being identical with the results of Example 4.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 6.4 lux-sec and the residual potential Vr was 12 V. From these data it is understood that the photosensitive member overcoating layer of the present invention does not impair the inherently superior sensitivity of the organic photosensitive layer. Furthermore, the overcoating layer obtained in Example 18 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 19 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 20

A photosensitive member having an overcoating layer of the present invention was formed in substantially the same manner as in Example 5 with the exception of substituting 1H,1H,5H-octafluoropentylmethacrylate gas heated by the first heater to a temperature of 125° C. for the diethylamine gas. The amount of halogen atoms, i.e. fluorine atoms, contained in the resulting a-C layer was approximately 19 atomic % based on the atoms of the entire structure, with the amount of other atoms being identical with the results of Example 5.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.5 lux-sec and the residual potential Vr was 10 V. From these data it is understood that the photosensitive member overcoating layer of the present invention does not impair the inherently superior sensitivity of the organic photosensitive layer. Furthermore, the overcoating layer obtained in Example 14 had a surface hardness of 7 H and greater based on measurements for pencil lead hardness as provided in Japanese Industrial Standards JIS K-5400, and it is understood that the high degree of surface hardness was a marked improvement.

EXAMPLE 21

A photosensitive member having a 2.1 μm overcoating layer of the present invention was formed in substantially the same manner as in Example 6 with the exception of substituting 1H,1H,5H-octafluoropentylmethacrylate gas heated by the first heater to a temperature of 145° C. for the diethylamine gas. The amount of halogen atoms, i.e. fluorine atoms, contained in the resulting a-C layer was approximately 23 atomic % based on the atoms of the entire structure, with the amount of other atoms being identical with the results of Example 6.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.3 lux-sec and the residual potential Vr was 9 V. From these data it is understood that the photosensitive member overcoating layer of the present invention does not impair the inherently superior sensitivity of the organic photosensitive layer. Furthermore, the overcoating layer obtained in Example 21 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 21 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 22

A photosensitive member having an overcoating layer of the present invention was formed in substantially the same manner as in Example 7 with the exception of substituting chlorine gas at 2 sccm for the ammonia gas. The amount of halogen atoms, i.e. fluorine atoms, contained in the resulting a-C layer was approximately 3 atomic % based on the atoms of the entire structure, with the amount of other atoms being identical with the results of Example 7.

Characteristics:

The photosensitive member of the invention thus obtained was charged at −600 V and one half the surface potential $E_{\frac{1}{2}}$ was measured using the corona discharge from a normal Carlson process; the $E_{\frac{1}{2}}$ was 2.3 lux-sec and the residual potential Vr was 7 V. From these data it is understood that the photosensitive member overcoating layer of the present invention does not impair the inherently superior sensitivity of the organic photosensitive layer. Furthermore, the overcoating layer obtained in Example 22 had a surface hardness of 7 H and greater based on measurements for pencil lead hardness as provided in Japanese Industrial Standards JIS K-5400, and it is understood that the high degree of surface hardness was a marked improvement.

EXAMPLE 23

A photosensitive member having an overcoating layer of the present invention was formed in substantially the same manner as in Example 8 with the exception of substituting chlorine gas for the nitrous oxide gas. The amount of halogen atoms, i.e. fluorine atoms, contained in the resulting a-C layer was approximately 2.8 atomic % based on the atoms of the entire structure, with the amount of other atoms being identical with the results of Example 8.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.2 lux-sec and the residual potential Vr was 8 V. From these data it is understood that the photosensitive member overcoating layer of the present invention does not impair the inherently superior sensitivity of the organic photosensitive layer. Furthermore, the overcoating layer obtained in Example 23 had a surface hardness of 7 H and greater based on measurements for pencil lead hardness as provided in Japanese Industrial Standards JIS K-5400, and it is understood that the high degree of surface hardness was a marked improvement.

In addition, when the photosensitive member of the invention obtained in Example 23 was installed in an actual copying machine and subjected to printing resistance testing of 10,000 A4-size copies, normal clear images were obtained and no reduction in layer thickness was noted, from which observations it is understood that the photosensitive member possesses superior durability. Furthermore, image drift was not observed during either normal temperature and moisture conditions or conditions of high temperature and moisture, from which it is understood that the photosensitive member possesses superior electrical consistency and superior ambience resistance. Neither was any separation of the overcoating layer noted following the 10,000 copy resistance test, from which it is understood that the photosensitive member possesses superior adhesion between the organic photosensitive layer and the overcoating layer.

EXAMPLE 24

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and third regulator valves 707, 708 and 709 were thereafter opened to introduce hydrogen gas from the first tank 701, butadiene gas from the second tank 702, and perfluoropropane gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 300 sccm, the butadiene gas at 90 sccm, and the perfluoropropane gas at 100 sccm, to the reactor 733 through the main pipe 732 via the intermediate mixer 731. Following stabilization of each gas flow, the internal pressure of the reactor 733 was adjusted to 0.8 torr by the pressure control valve 745. On the other hand, the organic photosensitive layer Fd was used as the substrate 752, said substrate being preheated to a temperature of 50° C. With the gas flow rates and the pressure in stabilized states, 160-watt power with a frequency of 50 KHz was applied to the power application electrode 736 from the low-frequency power source 741 pre-connected thereto by the selecting switch 744 to conduct plasma polymerization for approximately 2 min, forming an a-C layer, i.e. an overcoating layer, 0.2 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 30 atomic % of hydrogen atoms based on the combined amount of hydrogen and carbon atoms, and under Auger electron spectroscopy the layer was found to contain approximately 1.9 atomic % of fluorine atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 1.8 lux-sec and the residual potential Vr was 5 V. From these data it is understood that the photosensitive member overcoating layer of the present invention does not impair the inherently superior sensitivity of the organic photosensitive layer. Furthermore, the overcoating layer obtained in Example 24 had a surface hardness of 7 H and higher based on measurements for pencil lead hardness as provided in Japanese Industrial Standards JIS K-5400, and it is understood that the high degree of surface hardness was a marked improvement.

EXAMPLE 25

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately 10−6 torr, and the first, second and third regulator valves 707, 708 and 709 were thereafter opened to introduce helium gas from the first tank 701, butadiene gas from the second tank 702, and perfluoropropylene gas from the third tank 703 into the first second and third flow controllers 713, 714 and 715, respectively, each at an output pressure of 1.0 kg/cm$^2$. The dials on the flow controllers were adjusted to supply the helium gas at a flow rate of 300 sccm, the butadiene gas at 90 sccm, and the perfluoropropylene gas at 90 sccm, to the reactor 733 through the main pipe 732 via the intermediate mixer 731. Following stabilization of each gas flow, the internal pressure of the reactor 733 was adjusted to 0.8 torr by the pressure control valve 745. On the other hand, the organic photosensitive layer Gd was used as the substrate 752, said substrate being preheated to a temperature of 50° C. With the gas flow rates and the pressure in stabilized states, 160-watt power with a frequency of 50 KHz was applied to the power application electrode 736 from the low-frequency power source 741 pre-connected thereto by the selecting switch 744 to conduct plasma polymerization for approximately 2 min, forming an a-C layer, i.e. an overcoating layer, 0.23 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 33 atomic % of hydrogen atoms based on the combined amount of hydrogen and carbon atoms, and under Auger electron spectroscopy the layer was found to contain approximately 2.1 atomic % of fluorine atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 1.0 lux-sec and the residual potential Vr was 4 V. From these data it is understood that the photosensitive member overcoating layer of the present invention does not impair the inherently superior sensitivity of the organic photosensitive layer. Furthermore, the overcoating layer obtained in Example 25 had a surface hardness of 7 H and higher based on measurements for pencil lead hardness as provided in Japanese Industrial Standards JIS K-5400, and it is understood that the high degree of surface hardness was a marked improvement.

EXAMPLE 26

A photosensitive member of the present invention sequentially comprising a conductive substrate, organic photosensitive layer and overcoating layer, as shown in FIG. 1, was produced using a manufacturing apparatus related to the present invention.

In the glow discharge decomposition device shown in FIG. 2, first, the interior of the reactor 733 was evacuated to a high vacuum of approximately $10^{-6}$ torr, and the first, second and third regulator valves 707, 708 and 709 were thereafter opened to introduce argon gas from the first tank 701, butadiene gas from the second tank 702, and perfluoroethylene gas from the third tank 703 into the first second and third flow controllers 713, 714 and 715, respectively, each at an output pressure of 1.0 kg/cm$^2$. The dials on the flow controllers were adjusted to supply the argon gas at a flow rate of 300 sccm, the butadiene gas at 90 sccm, and the perfluoroethylene gas at 90 sccm, to the reactor 733 through the main pipe 732 via the intermediate mixer 731. Following stabilization of each gas flow, the internal pressure of the reactor 733 was adjusted to 0.8 torr by the pressure control valve 745. On the other hand, the organic photosensitive layer Hd was used as the substrate 752, said substrate being preheated to a temperature of 50° C. With the gas flow rates and the pressure in stabilized states, 160-watt power with a frequency of 50 KHz was applied to the power application electrode 736 from the low-frequency power source 741 pre-connected thereto by the selecting switch 744 to conduct plasma polymerization for approximately 2 min, forming an a-C layer, i.e. an overcoating layer, 0.25 μm thick on the substrate 752. After completion of the film formation, the power supply was discontinued, the regulator valves were closed, the reactor 733 was fully exhausted, whereupon the vacuum was broken and the photosensitive member of the present invention was removed.

When subjected to CHN quantitative analysis, the a-C layer thus obtained was found to contain 32 atomic % of hydrogen atoms based on the combined amount of hydrogen and carbon atoms, and under Auger electron spectroscopy the layer was found to contain approximately 2.2 atomic % of fluorine atoms based on the atoms of the entire structure.

Characteristics:

The photosensitive member of the invention thus obtained was charged at −600 V and one half the surface potential $E\frac{1}{2}$ was measured using the corona discharge from a normal Carlson process; the $E\frac{1}{2}$ was 2.1 lux-sec and the residual potential Vr was 7 V. From these data it is understood that the photosensitive member overcoating layer of the present invention does not impair the inherently superior sensitivity of the organic photosensitive layer. Furthermore, the overcoating layer obtained in Example 26 had a surface hardness of 7 H and higher based on measurements for pencil lead hardness as provided in Japanese Industrial Standards JIS K-5400, and it is understood that the high degree of surface hardness was a marked improvement.

EXAMPLES 27 TO 34

A photosensitive member overcoating layer of the present invention was produced using a manufacturing apparatus using a glow discharge decomposition apparatus as shown in FIG. 3.

First, the interior of the reactor 733 was evacuated to a high vacuum of approximately $10^{-6}$ torr, and the first, second, third and fourth regulator valves 707, 708, 709 and 710 were thereafter opened to introduce hydrogen gas from the first tank 701, butadiene gas from the second tank 702, carbon tetrafluoride gas from the third tank 703 and nitrogen gas from the fourth tank 704 into the first, second, third and fourth flow controllers 713, 714, 715 and 716, respectively, each at an output pressure of 1.0 kg/cm$^2$. The dials on the flow controllers were adjusted to supply the hydrogen gas at a flow rate of 300 sccm, the butadiene gas at 30 sccm, the carbon tetrafluoride gas at 90 sccm, and the nitrogen gas at 20 sccm, to the reactor 733 through the main pipe 732 via the intermediate mixer 731. Following stabilization of each gas flow, the internal pressure of the reactor 733 was adjusted to 0.5 torr by the pressure control valve 745.

On the other hand, the organic photosensitive layers Ad (Example 27), Bd (Example 28), Cd (Example 29), Dd (Example 30), Fd (Example 31), Gd (Example 32), Hd (Example 33) and Id (Example 34) were used as the substrate 752. The temperature of the substrates was raised from room temperature to 50° C. over a 15 min period prior to the introduction of the gases.

With the gas flow rates and the pressure in stabilized states, 160-watt power with a frequency of 50 KHz was applied to the power application electrode 736 from the low-frequency power source 741 pre-connected thereto by the selecting switch 744 to conduct plasma polymerization for approximately 2 min, forming an a-C layer, i.e. an overcoating layer, 0.20 μm thick on the substrate 752. After completion of the film formation, the power supply was discontinued, the regulator valves were closed with the exception of the hydrogen gas valve, hydrogen alone was fed into the reactor 733 at 200 sccm, a pressure of 20 torr was maintained, and the temperature was reduced to 30° C. over about a 15 min period. Thereafter, the hydrogen regulator valve was closed and the reactor 733 was fully exhausted, whereupon the vacuum was broken and the photosensitive member having an overcoating layer of the present invention was removed.

When subjected to organic quantitative analysis and Auger electron spectroscopy, the a-C layers thus obtained were found to contain 45 atomic % of hydrogen atoms based on the combined amount of hydrogen and carbon atoms, approximately 3.7 atomic % of halogen, i.e. fluorine atoms, and 1.2 atomic % of nitrogen atoms, based on the atoms of the entire structure.

Characteristics:

The surface of the photosensitive members thus obtained in Examples 27 through 34 had a surface hardness of about 6 H based on measurements for pencil lead hardness as provided in Japanese Industrial Standards JIS K-5400; the hardness of the photosensitive member overcoating layer of the present invention is thus verified. Also, the sensitivity of these members was virtually equal to that obtained in Examples 1 through 9. These data confirm that the overcoating layer of the present invention does not impair the inherent sensitivity of the organic photosensitive member.

In addition, the photosensitive members obtained in Examples 27 through 34 were exposed to atmospheric conditions of low temperature-low humidity (10° C. and 30% humidity) and high temperature-high humidity (50° C. and 90% humidity) which were alternated repeatedly every 30 min over a six hour period, and cracking or separation of the overcoating layer was not observed. These data confirm the photosensitive member overcoating layer of the present invention has superior adhesion properties regarding its adhesion to the photosensitive member.

When the photosensitive members of Examples 27 through 34 were installed in a copy machine and copies made as per the evaluations of Examples 1 through 9, clear images were obtained. No evidence of image drift was observed when copies were made at 35° C. and 80% relative humidity. Additionally, there was no indication of overcoating layer separation induced by contact with the developer, copy paper, or cleaning components within the copying machine. Clear images were obtained and no reduction in the overcoating layer was noted after 250,000 copies were made under normal room conditions. Comparison of the data in Table 1 verifies the remarkable effectiveness in preventing overcoating layer loss.

Evaluations after 10,000 copies, 50,000 copies, 100,000 copies or 250,000 copies, each test being conducted at 35% C. and 80% relative humidity, revealed no evidence of image drift, confirming the superior temperature resistance after printing. The results of these evaluations are shown in Table 3. In the table, the [O] mark indicates no evidence of image drift detected under conditions of 35° C. and 80% relative humidity; the [Δ] mark indicates partial image drift under identical conditions; the [X] mark indicates image drift throughout the entire copy under identical conditions.

It can be understood from the aforesaid data that the photosensitive member having an overcoating layer of the present invention achieves durability without loss of image quality, and that it particularly provides superior performance in regard to moisture resistance after printing.

TABLE 3

| Example | No. Copies 10,000 | No. Copies 50,000 | No. Copies 100,000 | No. Copies 250,000 |
|---|---|---|---|---|
| Ex. 27 | 0 | 0 | 0 | 0 |
| Ex. 28 | 0 | 0 | 0 | 0 |
| Ex. 29 | 0 | 0 | 0 | 0 |
| Ex. 30 | 0 | 0 | 0 | 0 |
| Ex. 31 | 0 | 0 | 0 | 0 |
| Ex. 32 | 0 | 0 | 0 | 0 |
| Ex. 33 | 0 | 0 | 0 | 0 |
| Ex. 34 | 0 | 0 | 0 | 0 |

EXAMPLES 35 TO 42

A photosensitive member overcoating layer of the present invention was produced using a manufacturing apparatus using a glow discharge decomposition apparatus as shown in FIG. 3.

First, the interior of the reactor 733 was evacuated to a high vacuum of approximately $10^{-6}$ torr, and the first, second, third and fourth regulator valves 707, 708, 709 and 710 were thereafter opened to introduce hydrogen gas from the first tank 701, propylene gas from the second tank 702, perfluoropropylene gas from the third tank 703 and ammonia gas from the fourth tank 704 into the first, second, third and fourth flow controllers 713, 714, 715 and 716, respectively, each at an output pressure of 1.0 kg/cm$^2$. The dials on the flow controllers were adjusted to supply the hydrogen gas at a flow rate of 300 sccm, the propylene gas at 30 sccm, the perfluoropropylene gas at 90 sccm, and the ammonia gas at 10 sccm, to the reactor 733 through the main pipe 732 via the intermediate mixer 731. Following stabilization of each gas flow, the internal pressure of the reactor 733 was adjusted to 0.5 torr by the pressure control valve 745.

On the other hand, the organic photosensitive layers Ad (Example 35), Bd (Example 36), Cd (Example 37), Dd (Example 38), Fd (Example 39), Gd (Example 40), Hd (Example 41) and Id (Example 42) were used as the substrate 752. The temperature of the substrates was raised from room temperature to 50° C. over a 15 min period prior to the introduction of the gases.

With the gas flow rates and the pressure in stabilized states, 200-watt power with a frequency of 125 KHz was applied to the power application electrode 736 from the low-frequency power source 741 pre-connected thereto by the selecting switch 744 to conduct plasma polymerization for approximately 2 min, forming an a-C layer, i.e. an overcoating layer, 0.25 μm in thickness on the substrate 752. After completion of the film formation, the power supply was discontinued, the regulator valves were closed with the exception of the hydrogen gas valve, hydrogen alone was fed into the reactor 733 at 200 sccm, a pressure of 20 torr was maintained, and the temperature was reduced to 30° C. over about a 15 min period. Thereafter, the hydrogen regulator valve was closed and the reactor 733 was fully exhausted, whereupon the vacuum was broken and the photosensitive member having an overcoating layer of the present invention was removed.

When subjected to organic quantitative analysis and Auger electron spectroscopy, the a-C layers thus obtained were found to contain 45 atomic % of hydrogen atoms based on the combined amount of hydrogen and carbon atoms, approximately 2.7 atomic % of halogen, i.e. fluorine atoms, and 1.0 atomic % of nitrogen atoms, based on the atoms of the entire structure.

Characteristics:

The surface of the photosensitive members thus obtained in Examples 35 through 42 had a surface hardness of about 6 H based on measurements for pencil lead hardness as provided in Japanese Industrial Standards JIS K-5400; the hardness of the photosensitive member overcoating layer of the present invention is thus verified. Also, the sensitivity of these members was virtually equal to that obtained in Examples 1 through 9. These data confirm that the overcoating layer of the present invention does not impair the inherent sensitivity of the organic photosensitive member.

In addition, the photosensitive members obtained in Examples 35 through 42 were were exposed to atmospheric conditions of low temperature-low humidity (10° C. and 30% humidity) and high temperature-high humidity (50° C. and 90% humidity) which were alternated repeatedly every 30 min over a six hour period, and cracking or separation of the overcoating layer was not observed. These data confirm the photosensitive member overcoating layer of the present invention has superior adhesion properties regarding its adhesion to the photosensitive member.

When the photosensitive members of Examples 35 through 42 were installed in a copy machine and copies made as per the evaluations of Examples 1 through 9, clear images were obtained. No evidence of image drift was observed when copies were made at 35° C. and 80% relative humidity. Additionally, there was no indication of overcoating layer separation induced by contact with the developer, copy paper, or cleaning components within the copying machine. Clear images were obtained and no reduction in the overcoating layer was noted after 250,000 copies were made under normal room conditions. Comparison of the data in Table 1 verifies the remarkable effectiveness in preventing overcoating layer loss.

Evaluations after 10,000 copies, 50,000 copies, 100,000 copies or 250,000 copies, each test being conducted at 35% C. and 80% relative humidity, revealed no evidence of image drift, confirming the superior temperature resistance after printing. The results of these evaluations are shown in Table 3.

It can be understood from the aforesaid data that the photosensitive member having an overcoating layer of the present invention achieves durability without loss of image quality, and that it particularly provides superior performance in regard to moisture resistance after printing.

TABLE 4

| Example | No. Copies 10,000 | No. Copies 50,000 | No. Copies 100,000 | No. Copies 250,000 |
|---|---|---|---|---|
| Ex. 35 | 0 | 0 | 0 | 0 |
| Ex. 36 | 0 | 0 | 0 | 0 |
| Ex. 37 | 0 | 0 | 0 | 0 |
| Ex. 38 | 0 | 0 | 0 | 0 |
| Ex. 39 | 0 | 0 | 0 | 0 |
| Ex. 40 | 0 | 0 | 0 | 0 |
| Ex. 41 | 0 | 0 | 0 | 0 |
| Ex. 42 | 0 | 0 | 0 | 0 |

EXAMPLES 43 TO 51

A photosensitive member having an overcoating layer of the present invention was formed in substantially the same manner as in Examples 27 to 34 with the exception of substituting carbon dioxide gas for the nitrogen gas in Examples 27 to 34. The amount of oxygen atoms contained in the resulting a-C layer was approximately 1.4 atomic % based on the atoms of the entire structure, with the amount of other atoms being identical with the results of Examples 27 through 34.

Characteristics:

Evaulations were preformed on the photosensitive members obtained in Examples 43 through 51 and the results were virtually identical to those for Examples 27 through 34, respectively, e.g., the photosensitive members provided with an overcoating layer of the present invention achieved durability without loss of image quality and superior moisture resistance ability was confirmed, particularly after resistance testing.

EXAMPLES 52 TO 59

A photosensitive member having an overcoating layer of the present invention was formed in substantially the same manner as in Examples 27 to 34 with the exception of substituting carbon dioxide gas for the nitrogen gas in Examples 27 to 34. The amount of oxygen atoms contained in the resulting a-C layer was approximately 0.8 atomic % based on the atoms of the entire structure, with the amount of other atoms being identical with the results of Examples 27 through 34.

Characteristics:

Evaluations were preformed on the photosensitive members obtained in Example 52 through 59 and the results were virtually identical to those for Examples 27 through 34, respectively, e.g., the photosensitive members provided with an overcoating layer of the present invention achieved durability without loss of image quality and superior moisture resistance ability was confirmed, particularly after resistance testing.

Comparative Examples 10 to 17

An overcoating layer which does not incorporate halogen or nitrogen atoms is provided on a photosensitive layer in substantially the same manner as in Examples 27 to 34 with the exception that carbon tetrafluoride gas and nitrogen gas are not introduced into the reactor.

The obtained test materials exhibited poor moisture resistance and produced image drift under high temperature conditions prior to use in resistance tests, thus confirming their impracticality.

Comparative Examples 18 to 25

Overcoating layers were manufactured in substantially the same manner as in Examples 27 through 34 excepting that the substrates were preheated to a temperature of 150° C. No sensitivity whatsoever was noted in the respective organic photosensitive members.

These results confirm the efficacy of the photosensitive member manufacturing process of the present invention whereby film formation occurs with the substrate at a temperature of 100° C. or less.

Comparative Examples 26 to 33

Overcoating layers were manufactured in substantially the same manner as in Examples 27 to 34 excepting that 300-watt power with a frequency of 13.56 MHz was applied to the power application electrode. At this rating, however, powder was produced on the substrate and the overcoating layer did not form.

Comparative Examples 33 to 40

Overcoating layers were manufactured in substantially the same manner as in Examples 27 to 34 excepting that 50-watt power with a frequency of 500 Hz was applied to the power application electrode. At this rating, however, discharge did not occur and the overcoating layer did not form.

What is claimed is:

1. A photosensitive member comprising:
an electrically conductive substrate;
an organic photoconductive layer comprising an organic material as a matrix; and
an overcoat layer formed on said photoconductive layer by an organic plasma polymerization with said substrate heated to a temperature not exceeding 100° C. and comprising amorphous carbon containing hydrogen, said overcoat layer containing one or more atoms selected from the group consisting of halogen, oxygen and nitrogen, and said overcoat layer having a thickness of about 0.01 to about 5 microns.

2. A photosensitive member as claimed in claim 1 wherein the amount of the hydrogen contained in the overcoat layer is about 5 to 50 atomic % based on the combined amount of hydrogen and carbon therein.

3. A photosensitive member as claimed in claim 1 wherein the amount of the halogen contained in the overcoat layer is about 0.01 to about 50 atomic % based on all the constituent atoms therein.

4. A photosensitive member as claimed in claim 3 wherein the amount of the halogen contained in the overcoat layer is preferably about 0.1 to about 10 atomic % based on all the constituent atoms therein.

5. A photosensitive member as claimed in claim 1 wherein the amount of the oxygen contained in the overcoat layer is about 0.01 to about 20 atomic % based on all the constituent atoms therein.

6. A photosensitive member as claimed in claim 5 wherein the amount of the oxygen contained in the overcoat layer is preferably about 0.1 to about 10 atomic % based on all the constituent atoms therein.

7. A photosensitive member as claimed in claim 1 wherein the amount of the nitrogen contained in the overcoat layer is about 0.01 to about 20 atomic % based on all the constituent atoms therein.

8. A photosensitive member as claimed in claim 7 wherein the amount of the nitrogen contained in the overcoat layer is preferably about 0.1 to about 10 atomic % based on all the constituent atoms therein.

9. A photosensitive member as claimed in claim 1 wherein said organic photoconductive layer comprises a binder resin and a dis-azo compound dispersed therein.

10. A photosensitive member as claimed in claim 1 wherein the photoconductive layer comprises phthalocyanine.

11. A photosensitive member as claimed in claim 1 wherein said photoconductive layer comprises a binder resin and a hydrazone compound dispersed therein.

12. A photosensitive member comprising:
an electrically conductive substrate;
an organic charge generating layer comprising an organic material as a matrix;
an organic charge transporting layer comprising an organic material as a matrix; and
an overcoat layer formed on said photoconductive layer by an organic plasma polymerization with said substrate heated to a temperature not exceeding 100° C. and comprising amorphous carbon containing hydrogen, said overcoat layer containing one or more atoms selected from the group consisting of halogen, oxygen and nitrogen, and said overcoat layer having a thickness of about 0.01 to about 5 microns.

13. A photosensitive member as claimed in claim 12 wherein the amount of the hydrogen contained in the overcoat layer is about 5 to 50 atomic % based on the combined amount of hydrogen and carbon therein.

14. A photosensitive member as claimed in claim 12 wherein the amount of the halogen contained in the overcoat layer is about 0.01 to about 50 atomic % based on all the constituent atoms therein.

15. A photosensitive member as claimed in claim 14 wherein the amount of the halogen contained in the overcoat layer is about 0.1 to about 10 atomic % based on all the constituent atoms therein.

16. A photosensitive member as claimed in claim 12 wherein the amount of the oxygen contained in the overcoat layer is about 0.01 to about 20 atomic % based on all the constituent atoms therein.

17. A photosensitive member as claimed in claim 16 wherein the amount of the oxygen contained in the overcoat layer is about 0.1 to about 10 atomic % based on all the constituent atoms therein.

18. A photosensitive member as claimed in claim 12 wherein the amount of the nitrogen contained in the overcoat layer is about 0.01 to about 20 atomic % based on all the constituent atoms therein.

19. A photosensitive member as claimed in claim 18 wherein the amount of the nitrogen contained in the overcoat layer is about 0.1 to about 10 atomic % based on all the constituent atoms therein.

20. A photosensitive member as claimed in claim 12 wherein said charge generating layer comprises a binder resin and a dis-azo compound dispersed therein.

21. A photosensitive member as claimed in claim 12 wherein said charge transporting layer comprises a binder resin and a hydrazone compound dispersed therein.

22. A photosensitive member as claimed in claim 12 wherein said charge generating layer comprises a phthalocyanine compound.

* * * * *